US009573781B2

(12) United States Patent
Kanemaru et al.

(10) Patent No.: US 9,573,781 B2
(45) Date of Patent: Feb. 21, 2017

(54) FEED DEVICE AND RECORDING APPARATUS

(71) Applicant: SEIKO EPSON CORPORATION, Tokyo (JP)

(72) Inventors: Shinji Kanemaru, Nagano (JP); Hitoshi Igarashi, Nagano (JP); Takayuki Tanaka, Nagano (JP); Tetsuya Tamura, Nagano (JP); Hiroyuki Tajima, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/739,448

(22) Filed: Jun. 15, 2015

(65) Prior Publication Data

US 2015/0375949 A1 Dec. 31, 2015

(30) Foreign Application Priority Data

Jun. 25, 2014 (JP) ..... 2014-130779

(51) Int. Cl.

| | |
|---|---|
| ***B65H 5/06*** | (2006.01) |
| ***B65H 3/06*** | (2006.01) |
| ***B65H 9/00*** | (2006.01) |
| ***B65H 5/34*** | (2006.01) |

(Continued)

(52) U.S. Cl.

CPC ..... *B65H 9/002* (2013.01); *B65H 3/0607* (2013.01); *B65H 3/0661* (2013.01); *B65H 3/0669* (2013.01); *B65H 3/5261* (2013.01); *B65H 5/062* (2013.01); *B65H 5/34* (2013.01); *B65H 7/08* (2013.01); *B65H 9/008* (2013.01); *B65H 2301/51212* (2013.01); *B65H 2403/512* (2013.01); *B65H 2403/942* (2013.01); *B65H 2404/1112* (2013.01); *B65H 2404/513* (2013.01); *B65H 2511/242* (2013.01); *B65H 2513/412* (2013.01); *B65H 2515/704* (2013.01); *B65H 2553/51* (2013.01);

(Continued)

(58) Field of Classification Search

CPC ..... B65H 9/008; B65H 9/002; B65H 5/34; B65H 7/06; B65H 7/02; B65H 7/14; B65H 7/20; B65H 3/06; B65H 3/0669

See application file for complete search history.

(56) References Cited

U.S. PATENT DOCUMENTS 6,805,342 B2 * 10/2004 Takahara ..... B65H 7/02 221/110
7,591,457 B2 * 9/2009 Yoshida ..... B65H 5/06 271/10.01

FOREIGN PATENT DOCUMENTS

JP 05270078 A * 10/1993
JP 2007-084224 A 4/2007

* cited by examiner

*Primary Examiner* — Luis A Gonzalez
(74) *Attorney, Agent, or Firm* — Global IP Counselors, LLP

(57) ABSTRACT

A feed device includes a feed roller, a transport roller pair provided further to the downstream side in the transport direction of a sheet than the feed roller, a first motor by which the feed roller is driven, and a second motor by which the transport roller pair is driven, and in which a controller that controls the first motor, and performs a skew removal operation accompanying reverse transport of the sheet by the transport roller pair causes a reverse current and a hold current as suppression currents that suppress the reverse transport amount of the feed roller to the reverse transport amount of the transport roller pair or less to flow to the first motor in at least a part of the skew removal operation.

15 Claims, 10 Drawing Sheets

(51) Int. Cl.
*B65H 3/52* (2006.01)
*B65H 7/08* (2006.01)

(52) U.S. Cl.
CPC .. *B65H 2553/81* (2013.01); *B65H 2701/1311* (2013.01); *B65H 2801/12* (2013.01)

FEED DEVICE AND RECORDING APPARATUS

BACKGROUND

1. Technical Field

The present invention relates to a feed device and a recording apparatus that perform a skew removal operation that removes skew (slant) of a medium in a process of feeding the medium.

2. Related Art

JP-A-2007-84224 discloses a recording apparatus provided with a feed device that has a skew removing function for a sheet (example of a medium). The recording apparatus is provided with a transport roller pair (example of a second roller) at a position further to the downstream side in the feeding direction than the feed roller (example of a first roller) in a process of feeding a sheet, and performs skew removal on the sheet by reversing the transport roller pair in a state where the feed roller is stopped after the leading edge of the sheet is delivered to the downstream side by a predetermined amount from the nip point of the transport roller pair. That is, a "biting operation" that delivers a predetermined amount of the leading edge of the sheet fed by the feed roller further to the downstream side than the nip point of the transport roller pair and, thereafter, a "discharging operation" in which the transport roller pair is reversed in a state where the feed roller is stopped are performed. Since the sheet is in a state of being nipped by the feed roller and a retard roller, the sheet, the leading edge of which is discharged to the upstream side, is bent between the feed roller and the transport roller pair, and the sheet leading is not at the nip point of the transport roller pair, that is, the sheet becomes parallel and skew is removed. In cases where the sheet is thick, because the feed roller is prevented from reversing when the discharging operation is performed, a braking unit (reversal prevention unit of the feed roller) is provided in the recording apparatus disclosed in JP-A-2007-84224.

A hopper is biased in a direction from the standby position towards the feeding position by an elastic member, and is inclined between the standby position and the feed position interlinked with the rotation of the rotation shaft of the feed roller by the power of the feed motor via engagement between a cam provided on the rotation shaft of the feed roller and a cam follower provided in the hopper.

Incidentally, due to causes such as a reduced diameter of the feed roller, slipperiness of the sheet in the feeding process, and variations in the feed start timing of the sheet, when the biasing force from the elastic member of the hopper acts on the rotation shaft in the process of the discharging operation performed with the feed motor in a stopped state, the feed roller reverses, and there are cases where skew removal is not appropriately performed. In the recording apparatus in JP-A-2007-84224, although a braking unit (feed roller reversal prevention unit) is provided for preventing the feed roller from reversing with the stiffness of a sheet formed from a thick sheet, there is a problem in that providing the braking unit prevents size reductions in the feed device and the printer, and the structure of the device becomes complicated.

This type of problem is not limited to the biasing force of the elastic member that biases the hopper being the cause, and in a configuration that performs skew removal by reverse transporting a medium with a second roller, it is similarly difficult to appropriately perform the skew removal even in cases where the first roller is excessively reversed by any external force.

SUMMARY

An advantage of some aspects of the invention is to provide a feed device and a recording apparatus able to appropriately perform skew removal on a medium in which the medium is reverse transported to the opposite side to the transport direction by reversing at least the second roller on the downstream side in the transport direction among the first roller and the second roller.

Below, means of the invention and operation effects thereof will be described.

According to an aspect of the invention, there is provided a feed device including: a first roller; a second roller provided further to the downstream side in a transport direction of a medium than the first roller; a first motor by which the first roller is driven; a second motor by which the second roller is driven; and a controller that controls the second motor and performs a skew removal operation accompanying reverse transport of the medium by the second roller, in which the controller causes a suppression current that suppresses the reverse transport speed of the first roller to the reverse transport speed of the second roller or less to flow to the first motor in at least a part of the skew removal operation period in which the skew removal operation is performed by the second roller reverse transporting the medium.

According to the configuration, the controller causes the second roller to reverse by controlling the second motor, and causes a suppression current to flow to the first motor in at least a part of the skew removal operation period. As a result, the medium is reverse transported to the upstream side in the transport direction by the reversal of the second roller, and the reverse transport speed (a speed of zero or more) of the first roller is suppressed to the reverse transport speed of the second roller or lower. Therefore, excessive reversal of the first roller is suppressed. For example, when the force that suppresses the reversal of the first roller is weakened by the first motor stopping in a state where the electrical conduction is cut off, there is concern of the first roller being reverse excessively rotated when an any external force (biasing force of a spring provided in the device as an example) is applied, and of a large force being generated in the reverse direction in the first roller. In this case, skew removal is not appropriately performed by the medium being stretched to the upstream side in the transport direction at a part between the first roller and the second roller. However, excessive reversal of the first roller or the occurrence of a larger force in the reverse direction is suppressed by the suppression current flowing to the first motor. Skew removal on a medium may be suitably performed in which the medium is reverse transported to the opposite side to the transport direction by reversing the second roller on the downstream side in the transport direction from at least the first roller and the second roller.

In the feed device, it is preferable for the suppression current to be a hold current that holds the first motor in a stopped state.

According to the configuration, because the hold current flows to the first motor in at least a portion of the skew removal operation period in which the second roller is reversed by the second motor, the first roller is held in the stopped state (that is, a state where the reverse transport amount is zero). Thus, skew removal of the medium can be appropriately performed.

In the feed device, it is preferable that the suppression current is a reverse current with a value able to cause the first roller to perform reverse transport at a reverse transport amount of the reverse transport amount of the second roller or less, and the controller drives the first motor to reverse by causing the reverse current to flow to the first motor in the process of the skew removal.

According to the configuration, the first roller is reversed by a reverse transport amount of the reverse transport amount of the second roller or less by the reverse current flowing to the first motor in at least a portion of the skew removal operation period in which the second roller is reversed by the second motor. Thus, even if any external force is received, because the first motor is electrically connected by the reverse current flowing, it is possible to suppress an excessive reversal in which the reverse transport amount of the first roller is greater than the reverse transport amount of the second roller, compared to a case of a stop state in which the electrical conduction is disconnected. The bending amount of the medium at the part between the first roller and the second roller is comparatively shortened through the reversal of the first roller. Accordingly, skew removal of the medium can be appropriately performed while suppressing the bending amount of the medium between the first roller and the second roller to be short.

In the feed device, it is preferable that the suppression current is a reverse current with a value able to cause the first roller to perform reverse transport at a reverse transport amount of the reverse transport amount of the second roller or less, and the controller drives the first motor to reverse by causing the reverse current to flow to the first motor in the process of the skew removal.

According to this configuration, reversal of the first roller due to the recovery force that tends to resolve the bending of the medium formed with the first roller by the medium being reverse transported by the second roller is assisted by the reverse current flowing to the first motor, in at least a portion of the skew removal period. Thus, reversal of the bending of the first roller is possible using the recovery force of the medium formed by the reversal of the second roller. Since the first roller is reversed using the recovery force of the bending of the medium in this way, it is possible to suppress stretching of the medium due to excessive reversal of the first roller after suppressing the bending of the medium to be short. Thus, skew removal of the medium can be appropriately performed while suppressing the bending amount of the medium formed between the first roller and the second roller to be short, in the process of the skew removal.

The feed device further preferably includes a hopper on which a medium before feeding is mounted, and that is provided to be displaceable in a state of being biased by an elastic member in a direction approaching the first roller, in which a rotation shaft of the first roller may be interlinked to operate with the hopper via a cam mechanism, and the hopper may be operated by resisting the biasing force of the elastic member via the cam mechanism in the rotation region of the first roller in which the skew removal operation is performed.

According to the configuration, in the rotation region of the first roller in which skew removal is performed, the hopper is operated by resisting the biasing force of the elastic member via the cam mechanism. Thus, in at least a part of the skew removal operation period, even if a biasing force due to the elastic member is applied to the first roller, it is possible for the first roller to be suppressed from reversing at a faster excessive reverse transport speed than the reverse transport speed of the second roller. Accordingly, skew removal can be appropriately performed.

In the feed device, it is preferable that the first roller is linked to the first motor to be able to transmit force via a one-way clutch, and the controller drives the first motor to reverse by causing a reverse current as the suppression current to flow to the first motor matching the reversal driving of the second motor in at least a part of the skew removal operation period. The reverse driving of the first motor may be able to provide a force in the reverse direction to a one-way clutch, and it is not necessary for the output shaft of the first motor to reversely rotate.

According to the configuration, in at least a portion of the skew removal operation period, the controller matches the reverse driving of the second motor and the first motor is reverse driven by a reverse current as a suppression current flowing. By the first motor being reverse driven, a force in the reverse direction is applied to the one-way clutch. As a result, it is possible for the load from the one-way clutch to be reduced when the feed motor is reversed and for the first roller to be reversed using the recovery force due to bending of the medium. Thus, the bending amount of the medium between the first roller and the second roller can be suppressed to be short, and skew removal operation can be appropriately performed while reducing damage such as folding of the medium caused by an excessive bending amount.

In the feed device, it is preferable that the controller drives the first motor to reverse by causing the reverse current as the suppression current to flow to the first motor in at least a part of the period in which the medium is nipped in the second roller from the skew removal operation period, and thereafter, at least in a period in which the medium is not nipped by the second roller, and a hold current as the suppression current flows to the first motor.

According to the configuration, in at least a part of the period in which the medium is nipped by the second roller in the skew removal operation period, the first motor is reverse driven by the reverse current flowing to the first motor. Therefore, by the first motor being moderately reversed while suppressing excessive reversal, it is possible to suppress the formation of an excessive bending amount. Therefore, in at least the period in which the medium is not nipped by the second roller, a hold current flows to the first motor. Therefore, even if some external force is applied to the first roller, it is possible for the first roller to be suppressed from excessively reversing. Thus, skew removal of the medium can be appropriately performed while suppressing the occurrence of damage such as folding to the medium caused by an excessive folding amount of the medium between the first roller and the second roller.

In the feed device, it is preferable that the controller varies the current value to increase and decrease the current by which the first motor is reversed, a plurality of times, in at least a part of the skew removal operation period. Cases where the reverse current is reduced include cases where the current value that flows in a state where the first motor is able to be electrically connected is zero and cases where the hold current at which the reverse speed of the first motor is zeros flows to the first motor.

According to the configuration, since the controller varies the current value to increase and decrease the current by which the first motor is reversed, a plurality of times, in at least a part of the skew removal operation period, it is possible to repeat the reversal of the first motor due to the formation of the bending of the medium for skew removal and the recovery force of the medium that tends to remove the bend. Thus, skew removal of the medium can be appropriately performed while suppressing damage such as folding to the medium caused by an excessive folding amount of the medium between the first roller and the second roller.

According to another aspect of the invention, there is provided a recording apparatus including the feed device; and a recording head that performs recording on a medium fed by the feed device. According to the configuration, the medium which is fed by the feed device is subjected to recording with the recording head. At this time, in the feeding process of the medium, it is possible to perform skew removal on a medium in which the medium is reverse transported to the opposite side to the transport direction by reversing the second roller on the downstream side in the transport direction at least the first roller and the second roller. As a result, recording can be appropriately performed on a medium with little skew.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, an embodiment in which a printer that is an example of a printing device is realized will be described with reference to the drawings.

Figure 1:
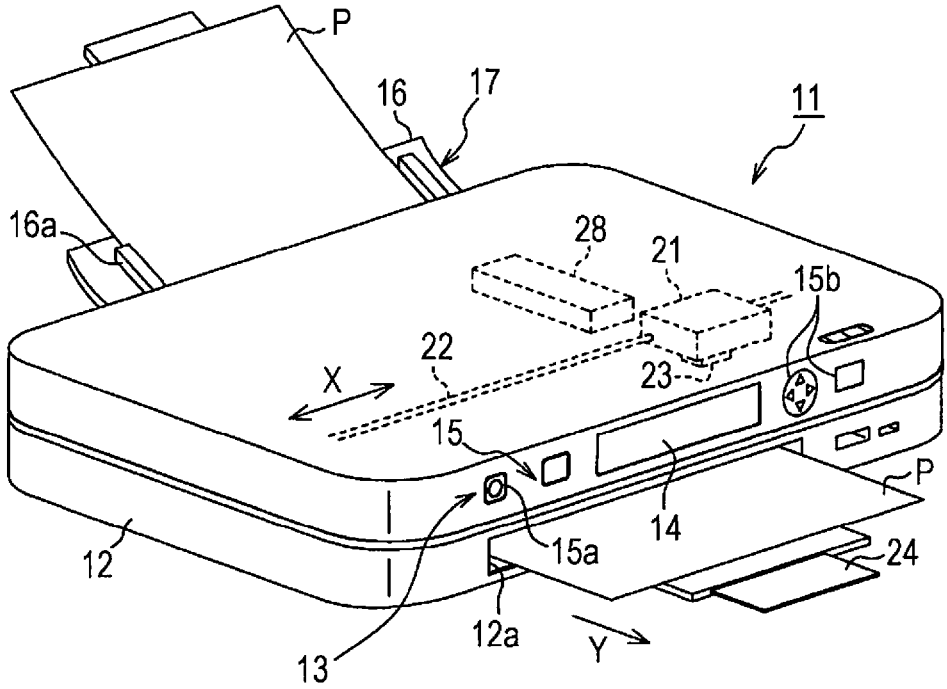
FIG. 1 is a perspective view showing a printer in an embodiment.

As shown in FIG. 1, the printer 11 is a mobile-type ink jet color printer as an example. An operation panel 13 used by a user for input operations and the like is provided in the front surface (right surface in FIG. 1) of the device main body 12 having a thin substantially parallelepiped shape. For example, a display portion 14 formed from a liquid crystal panel and an operation portion 15 consisting of an operation switch group are provided on the operation panel 13. A plurality of operation switches 15*b* and the like operated when selecting power switch 15*a* and a desired item on a menu screen of a display portion 14 is included in the operation portion 15.

As shown in FIG. 1, an automatic feed device 17 (below, simply referred to as "feed device 17") as an example of a feed device including a feed tray 16 on which a sheet P is able to be set in a state of being positioned in the width direction by a pair of edge guides 16*a* is provided on the rear surface portion of the device main body 12. The feed device 17 may be also provided with a set feeding method win which sheets are fed one at a time from a sheet group in a feed power set detachably mounted to the device main body 12 or a roll sheet feed method in which a roll sheet set on the outside or the inside of the device main body 12 is continuously fed, in addition to the hopper method in which the feed tray 16 is provided.

As shown in FIG. 1, a serial printing mechanism is provided in the device main body 12. The carriage 21 that configures the printing mechanism is provided in a state able to reciprocate in the scanning direction X guided on the guide shaft 22. The recording head 23 is removed from the lower portion of the carriage 21. The sheet P is fed by the feed device 17 to a position at which recording by the recording head 23 is possible. The fed sheet P is subjected to printing of text or images or the like on the sheet by ejecting ink droplets from the recording head 23 to the surface of the sheet P in the process in which the carriage 21 moves in the direction X. The printed sheet P is discharged from the discharge port 12*a* on the front surface of the device main body 12, and stacked on a slide-type stacker 24 (sheet discharge tray).

In the device main body 12, in addition to being able to supply a predetermined voltage in which the alternating current from a commercial AC power source 30 (refer to FIG. 6) is converted via an AC adapter, not shown, it is possible to use a battery 28 stored in the device main body 12 as a power source for the printer 11 when mobile or the like.

Figure 3:
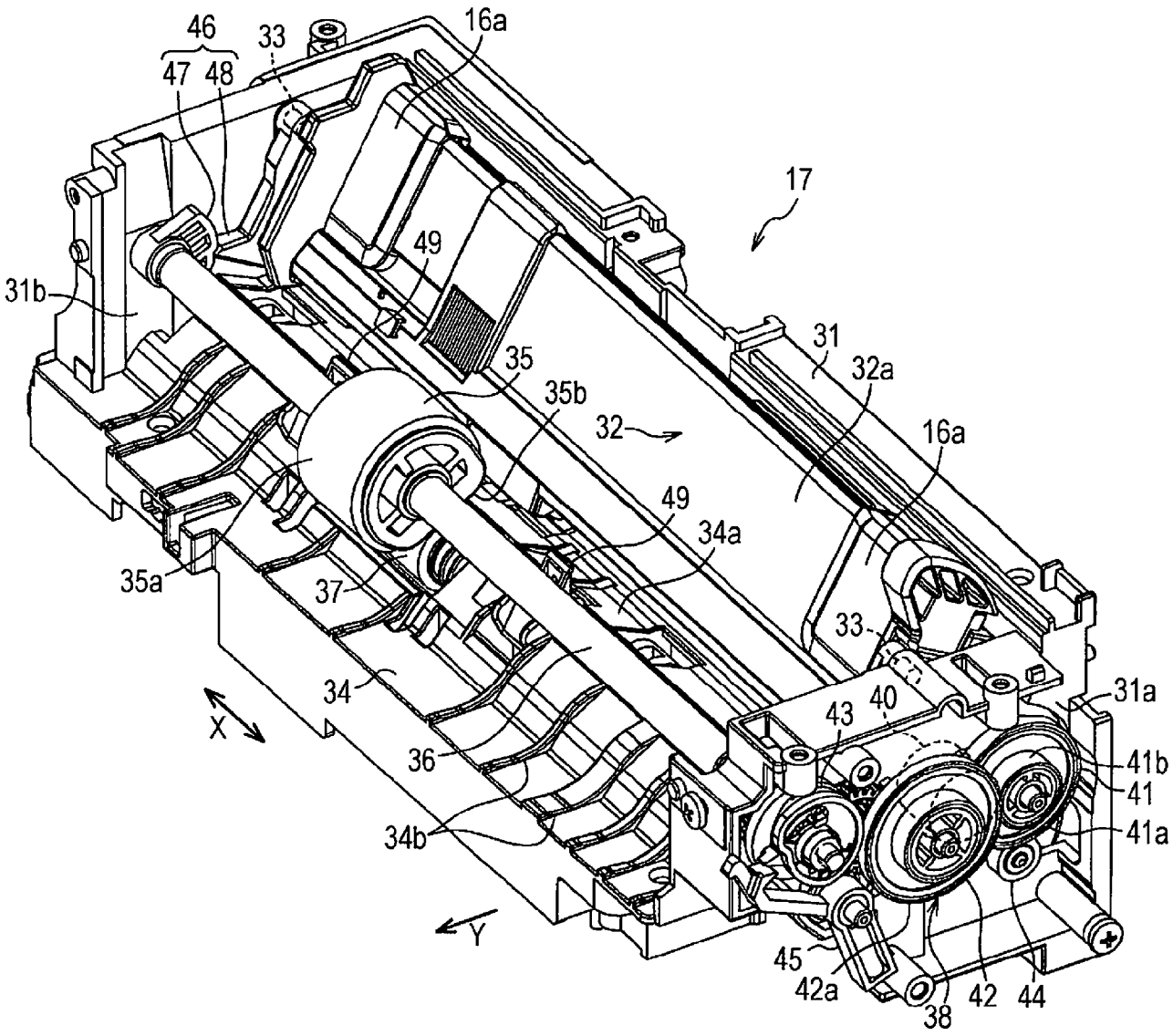
FIG. 3 is a perspective view showing an automatic feed device.

Next, the configuration the automatic feed device 17 will be described with reference to FIG. 3. As shown in FIG. 3, a substantially square box-shaped main body frame 31 that is opened on the upper side and the front side is arranged in the device main body 12 (refer to FIG. 1), and is attached to a position of the rear surface side on the inside thereof in a state of having an inclined posture able to incline with the support shaft 33 that positions the square plate-like hopper 32 extending in the width direction (same as the scanning direction X) slightly further upward than both sides in the width direction as a center. A mounting surface portion 32*a* on which the sheet is set and a pair of edge guides 16*a* able to position the sheet set on the mounting surface portion 32*a* in the width direction are provided in the hopper 32.

On the lower side of the hopper 32, a guide formation member 34 made of resin having a medium guide surface 34*a* able to support the leading edge (lower end portion) of the sheet group of which the upper surface (bottom surface)

thereof is mounted (set) on the hopper 32 from the lower side is formed slightly wider than the maximum sheet width in the scanning direction X.

One feed roller 35 as an example of the first roller is provided in a state in which the rotation shaft 36 suspended at a position further upward than the guide formation member 34 is fixed is provided at a substantially central position in the width direction further to the downstream side in the feed direction Y than the hopper 32. The feed roller 35 of the embodiment is configured by a D-shaped roller in which the shape in side view seen from the direction of the axial line thereof has a letter D shape. The outer peripheral surface of the feed roller 35 includes a circular arc surface 35*a* able to contact the sheet P on the hopper 32 inclined at the feed position (raising position) and a flat surface 35*b* able to separate from the sheet P on the hopper 32.

As shown in FIG. 3, a retard roller 37 able to rotate in a state of being exposed from the guide formation member 34 and with a smaller diameter than the feed roller 35 is provided at a position on the lower side facing the feed roller 35. The medium guide surface 34*a* is formed on a surface with a gradient slightly rising toward the downstream side in the feed direction in a region up to being nipped by the feed roller 35 and the retard roller 37. In the guide formation member 34, the region in which the sheet is delivered by being nipped by the feed roller 35 and the retard roller 37 is formed on a surface with a gradient that lowers toward the downstream side in the feed direction and the downstream side thereof is a comparatively horizontal flat surface. A plurality of rigs is formed spaced by gaps in the width direction and so as to extend along the transport direction Y, and a medium guide portion 34*b* that supports the sheet fed by the feed roller 35 and the retard roller 37 from the lower side is formed by the plurality of ribs.

The first motor 40 (feed motor) provided on the lower portion of the right end in FIG. 3 of the main body frame 31 is a power source of the automatic feed device 17. The power transmission mechanism 38 that transmits power from the first motor 40 to the rotation shaft 36 is arranged on the outside of one (right side in FIG. 3) side plate 31*a* of the main body frame 31. The feed roller 35 is rotated by the rotation shaft 36 rotates according to the output of the power transmission mechanism 38.

The power transmission mechanism 38 includes two two-stage gears 41 and 42 and a one-way clutch 43. A pinion 44 fit to the drive shaft of the first motor 40 meshes with the large diameter portion 41*a* of the two-stage gear 41, and the large diameter portion 42*a* of the two-stage gear 42 engages with the small diameter portion 41*b* of the two-stage gear 41. The rotation of the two-stage gears 42 is input to the one-way clutch 43. The one-way clutch 43 permits only transmission of the rotation force in one direction to the rotation shaft 36 of the feed roller 35, and does not permit transmission of the rotation force in the opposite direction. That is, although rotation in the feed direction (positive direction) is transmitted to the feed roller 35 via the one-way clutch 43, and rotation (reversal) to the opposite side to the feed direction is not transmitted. However, the feed roller 35 is able to freely reversely rotate independently of the one-way clutch 43 simply by the power of the reverse rotation not being transmitted from the first motor 40. A trigger lever 45 is provided in a state able to rotate within a predetermined angle range at a position in the vicinity of the lower side of the one-way clutch 43, and the leading edge is able to latch with one location on the outer periphery of the one-way clutch 43. The feed roller 35 is stopped when rotating once from the standby position by the trigger lever 45 latching with the one-way clutch 43 when the feed roller 35 rotates once.

A cam mechanism 46 that converts the rotation of the rotation shaft 36 to the inclining operation of the hopper 32 is provided on the other end portion that is the opposite side to the one end portion on the one-way clutch 43 in the rotation shaft 36, further to the inner surface side than the side plate 31*b* on the left side in FIG. 3. The cam mechanism 46 includes a cam 47 that is fit to the other end portion of the rotation shaft 36 and a cam follower 48 formed to be able to engage with the cam 47 on the other end portion of the hopper 32.

A pair of stoppers 49 provided to be able to retract from the medium guide surface 34*a* is provided in a region between the hopper 32 and the feed roller 35 in the transport direction Y in a state of being biased upward by the biasing force of a spring (not shown). The pair of stoppers 49 is at the standby position projecting before feeding, is inserted in the retreated position not projecting from the medium guide surface 34*a* so as to permit the delivery of the uppermost sheet P on the hopper 32 in the feeding process, and, thereafter, is arranged projecting at the standby position in order to prevent multiple feeding in which a subsequent sheet P is fed together. The pair of stoppers 49 is formed so that the feed roller 35 is retracted at a predetermined timing in a process of rotating once via the cam mechanism 75 (refer to FIG. 6) through the power of the first motor 40.

Figure 2A:
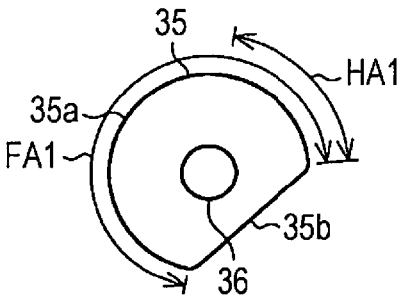
FIG. 2A is a side view showing a feed roller of the embodiment.
Figure 2B:
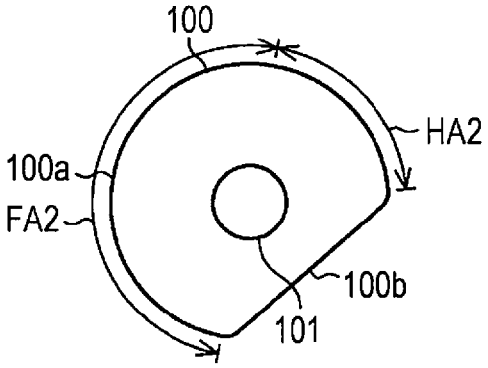
FIG. 2B is the side view showing a feed roller of a comparative example.

Next, the characteristics of the feed roller of the embodiment will be described with reference to FIGS. 2A and 2B while comparing to the feed roller of a comparative example. FIG. 2A shows a side view of feed roller 35 of the embodiment, and FIG. 2B shows a side view of the feed roller 100 of the comparative example corresponding to the technology of the related art. As shown in FIG. 2B, the feed roller 100 of the comparative example is a D-shaped roller having a circular arc surface 100*a* and a flat surface 100*b*, similarly to the feed roller 35 shown in FIG. 2A, and the outer diameter from the center of the rotation shaft 101 and to the circular arc surface 100*a* is a larger diameter than that in FIG. 2A.

The feed rollers 35 and 100 shown in FIGS. 2A and 2B come into contact with the sheet on the hopper with either of the circular arc surfaces 35*a* and 100*a*, and feeding of the sheet is possible with a segment of the circular arc surface. The feed rollers 35 and 100 lower the hopper via the cam mechanism 46 by resisting the elastic force of the compression spring 51 (refer to FIGS. 4A to 4C) until returning to the standby state in the same drawing by rotating once. At this time, the biasing force in the reverse direction is applied to the rotation shaft 36 according to the elastic force of the compression spring 51 of the hopper. When the biasing force in the reverse direction is applied, there is concern of the leading edge of the sheet being nipped by the transport roller pair, and of the sheet begin reverse transported according to the reversal of the feed roller when the nipping force is comparatively weak. Therefore, as shown in FIG. 2B, in the feed roller 100 of the related art (comparative example), the feed usage region FA2 used in feeding until completion of the biting operation in which the leading edge of the sheet P is nipped by the transport roller pair and the hopper retreat region HA2 that is the process in which the hopper is retreated from the feed position to the standby position by resisting the biasing force of the compression spring are set in a different angle range that do not overlap. Therefore, the peripheral length of the circular arc surface 100*a* is comparatively long, and this is a cause of size increases in the feed roller 100.

In contrast, in the feed roller 35 of the embodiment shown in FIG. 2A, the entire region in the circumferential direction of the circular arc surface 35*a* is the feed usage region FA1 used in feeding until completion of the biting operation of the medium. The hopper retreat region HA1 that is the process in which the hopper 32 is retreated (lowered) from the feed position to the standby position by resisting the biasing force of the compression spring 51 overlaps the termination end side of the feed usage region FA1. Therefore, it is possible for the peripheral distance of the circular arc surface 35*a* of the feed roller 35 to be shorter than the peripheral distance of the circular arc surface 100*a* of the comparative example and the feed roller becomes comparatively small (reduced diameter) compared that of the comparative example.

However, when the hopper retreat region HA1 overlaps the feed usage region FA1, in the skew removal process described later, the first motor 40 is stopped in a state in which the leading edge of the sheet P is not nipped by the transport roller pair 53 (refer to FIGS. 4A to 4C) as an example of the second roller in the hopper retreat region HA. Therefore, there is concern of the sheet P being excessively reverse transported by the feed roller 35 being suddenly reversed according to the biasing force of the compression spring 51. The reverse transport of the sheet P is a cause of reduction in the skew removal effect, and lowering of the cuing position precision in which the sheet is stopped at the printing start position (cuing position). Here, in the embodiment, even while using the small diameter feed roller 35 shown in FIG. 2A, countermeasures that suppress reduction of the skew removal effect or lowering of the cuing position precision are performed according to the motor control. The details of the motor control will be described later.

Figure 4A:
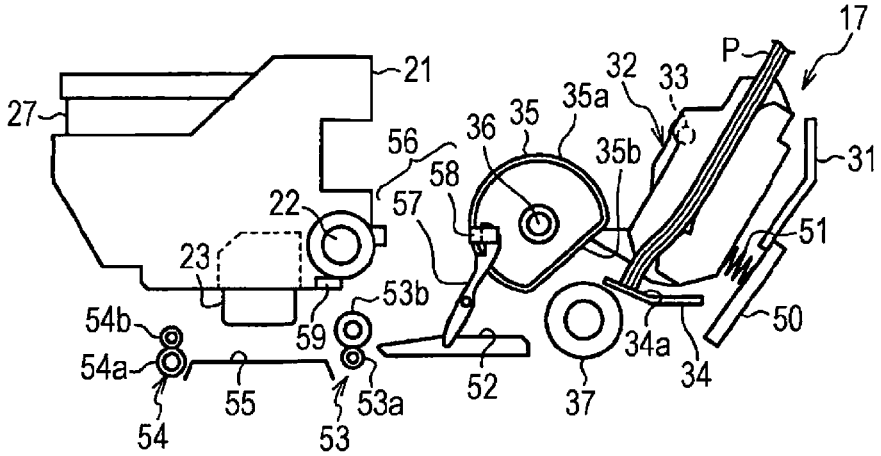
FIGS. 4A to 4C are schematic side view describing the operation of the automatic feed device.
Figure 4B:
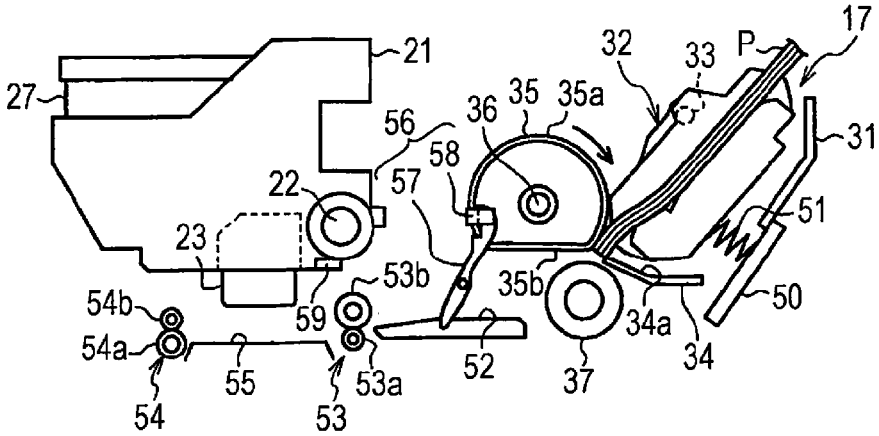
Figure 4C:
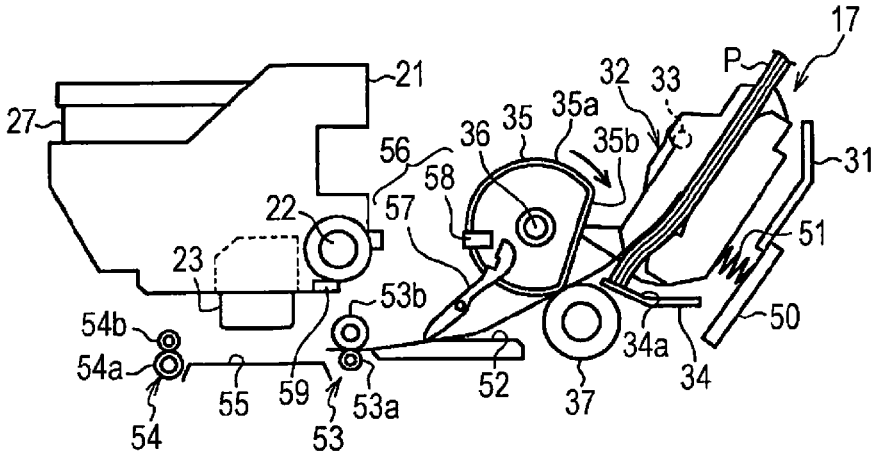

Next, the operation of the feed device 17 will be described with reference to FIGS. 4A to 4C. As shown in FIGS. 4A to 4C, the hopper 32 arranged obliquely is supported in a state able to incline in a range of a predetermined angle with the support shaft 33 of the part close the upper side thereof as the center. The hopper 32 is biased in a direction (upward left direction in FIGS. 4A to 4C) approaching the feed roller 35 by the compression spring 51 interposed with the support member 50 fixed to the main body frame 31. The feed roller 35 is arranged in the vicinity of the lower end of the hopper 32 in a state in which the rotation shaft 36 is rotatable around the center. The sheet P is set in a state in which the rear surface thereof is supported on the mounting surface portion 32*a*, and the leading edge (lower end portion) thereof is supported on the medium guide surface 34*a* in the hopper 32. The hopper 32 reciprocates between the standby position shown in FIGS. 4A to 4C separated from the feed roller 35 and the feed position shown in FIG. 4B at which the set sheet P is able to contact the feed roller 35.

A retard roller 37 that, with the feed roller 35, delivers the uppermost sheet P is arranged at a location facing the feed roller 35. The retard roller 37 able to be driven to rotate and is biased by a spring, not shown, in a direction approaching the feed roller 35 in a state in which a fixed rotation load is applied by a torque limitation mechanism such as a torque limiter. When the hopper 32 is arranged at the feed position shown in FIG. 4B, the fed sheet P is pinched between the feed roller 35 and the retard roller 37. The sheet P fed by the feed roller 35 and the retard roller 37 is transported to the downstream side in the transport direction while being guided to the upper surface of the guide member 52 that forms a transport path.

A transport roller pair 53 and a discharge roller pair 54 are respectively arranged at each position on the upstream side and the downstream side with the support stand 55 interposed in the transport direction Y further to the downstream side in the transport direction (feed direction) than the delivery position by the feed roller 35 and the retard roller 37. A support stand 55 is arranged further to the lower side than the transport path of the sheet P, and at least supports a part of the sheet P on which printing is performed by the recording head 23.

As shown in FIG. 4B, when the feed roller 35 is rotated in the clockwise direction in the same drawing in a state in which the hopper 32 moves upward to the feed position, the uppermost sheet P is fed to the downstream side in the feed direction while being separated from another sheet by the retard roller 37.

As shown in FIGS. 4A to 4C, a sheet detector 56 (sheet presence sensor) able to detect the presence of a sheet in the transport path is provided at a position between the feed roller 35 and the transport roller pair 53. The sheet detector 56 includes a lever 57 in which the lower end thereof extends with a length that reaches the sheet transport path, and an optical sensor portion 58 in which the lower end portion of the lever 57 is a detection target. The sheet detector 56 is turned off by the lever 57 returning to the origin position shown in FIGS. 4A and 4B with the biasing force of a spring, not shown, in a state where there is no sheet P in the detection region, and is turned on when the leading edge of the fed sheet P pushes the lower end of the lever 57 thereby inclining the lever as shown in FIG. 4C. In the printer 11, the position of the sheet P in the transport direction Y is managed with the sheet position when the sheet detector 56 detects the leading edge of the sheet P and turned on as a standard (for example, origin point). Although the sheet P is fed until the leading edge thereof reaches the printing start position with the recording head 23, a skew removal operation, described later, is performed accompanying the reverse transport to the upstream side in the transport direction of the sheet P by the reversal of the transport roller pair 53 in order to remove the skew (slant) in which the sheet P is obliquely inclined with respect to the transport path during the feed operation.

The transport roller pair 53 and the discharge roller pair 54 are driven by the second motor 60 (transport motor) (refer to FIG. 6) as a power source. Each roller pair 53 and 54 is configured, respectively, by driving rollers 53*a* and 54*a* that rotate and drive with the power of the second motor 60, and driven rollers 53*b* and 54*b* that come in contact with and rotate together with the driving rollers 53*a* and 54*a*, respectively. The sheet P is transported to the transport direction Y in a state of being pinched (nipped) at two locations in the transport direction Y by both roller pairs 53 and 54.

A sheet width sensor 59 is provided at a position further to the upstream side in the transport direction Y than the recording head 23 in the carriage 21. The sheet width sensor 59 is an optical sensor that detects reflection light of light irradiated toward the support stand 55, and detects the leading edge of the sheet P by the carriage 21 standing by at a position at which the sheet P is fed, and detects the side edges in the scanning direction X (width direction) of the sheet during movement in the scanning direction X of the carriage 21.

As shown in FIG. 4C, the biting operation in which the leading edge is bitten by the transport roller pair 53 in a state in which the leading edge of the sheet P fed from the hopper 32 is nipped by the transport roller pair 53 and projected by a predetermined length to the downstream side during the feeding process of cuing at the printing start position. From this state, the discharging operation is performed by reverse transporting the sheet P to the upstream side in the transport direction, releasing the nipping of the sheet P by the transport roller pair 53 and discharging the leading edge thereof from the transport roller pair 53 to the upstream side in the transport direction Y. The skew (slant) of the sheet P is removed using the recovery force due to the bending of the sheet P according to the discharge operation of the sheet P.

Show FIGS. 4A to 4C, the carriage 21 reciprocates an upper position that faces the transport path of a part between the transport roller pair 53 and the discharge roller pair 54 along the scanning direction X (direction orthogonal to the paper surface in FIGS. 4A to 4C). An ink cartridge 27 in which ink is accommodated is detachably mounted to the carriage 21. Ink supplied from the ink cartridge 27 is ejected from the nozzles of the recording head 23 toward a part of the sheet P supported by the support stand 55.

In the serial printer 11, text and images or the like are printed on the sheet P by substantially alternately repeating a printing operation of performing one scan by ejecting ink from the recording head 23 to the sheet P during scanning of the carriage 21, and a transport operation of transporting the sheet P to the next recording position. Although the printer 11 is a serial printer in which the recording head 23 is moved in the scanning direction as an example, a line printer having a line head configured by a single or head group with a long shape may be used.

Next, the configuration and operation of the cam mechanism by which the rotation of the feed roller 35 and the inclining of the hopper 32 will be described with reference to FIGS. 5A to 5D.

Figure 5A:
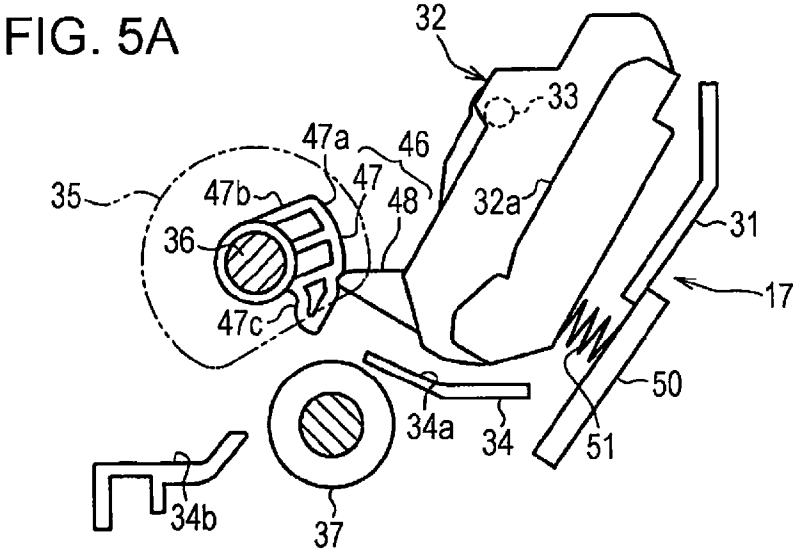
FIGS. 5A to 5D are schematic side views showing a condition in which the feed roller and a hopper in the automatic feed device are interlinked via a cam mechanism.

As shown in FIG. 5A, the cam 47 fixed to one end portion of the rotation shaft 36 has a substantially circular arc first cam surface 47*a* formed with a substantially fixed diameter from the rotation shaft 36 as a part able to hold the hopper 32 to the standby position. The end surface on the opposite side in the cam rotation direction (clockwise direction in FIGS. 5A to 5D) of the cam 47 is the second cam surface is the second cam surface 47*b*. The second cam surface 47*b* is a surface that intersects the circumferential direction of the feed roller 35. A part of on the leading edge side of the cam 47 in the cam rotation direction is projected in a triangular shape, and the inner peripheral surface close to the rotation shaft 36 of the triangular part thereof is the third cam surface 47*c*.

In the standby state shown in FIG. 5A, a state is reached in which the leading edge of the triangular cam follower 48 comes in contact with the first cam surface 47*a* of the cam 47. When the first motor 40 is forward driven, the feed roller 35 and the cam 47 rotate in the clockwise direction in FIGS. 5A to 5D with the rotation shaft 36. As a result, the leading edge of the cam follower 48 moves along the first cam surface 47*a*.

Figure 5B:
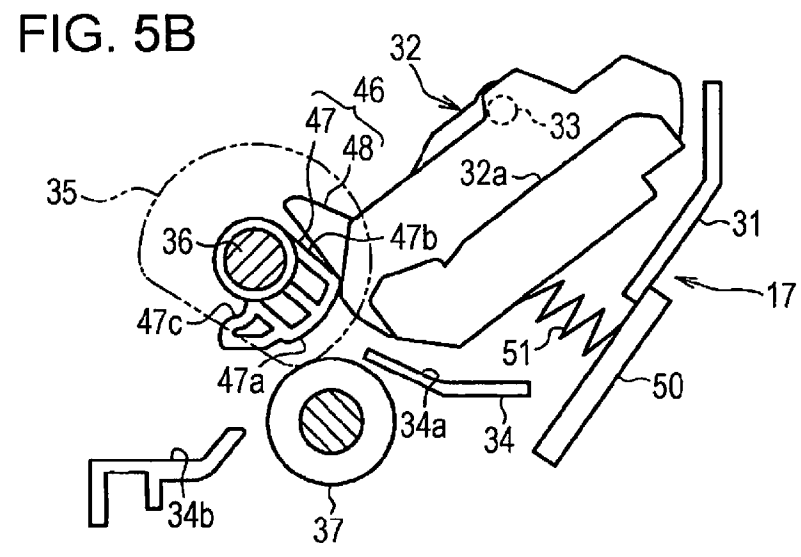

As shown in FIG. 5B, when the leading edge of the cam follower 48 reaches the second cam surface 47*b*, because the cam 47 is removed from the position facing thereto, the cam follower 48 moves to a position close to the rotation shaft 36 along the second cam surface 47*b* with the biasing force of the compression spring 51. Next, the hopper 32 moves from the standby position shown in FIG. 5A to the feed position shown in FIG. 5B according to the biasing force of the compression spring 51. As a result, the sheet P (refer to FIG. 4B) on the hopper 32 contacts the circular arc surface 35*a* of the feed roller 35 and the uppermost sheet is delivered to the downstream side in the feed direction, and, along therewith, is fed further to the downstream side while being nipped between the circular arc surface 35*a* and the retard roller 37. Thereafter, the feed roller 35 rotates in a state in which the cam 47 and the cam follower 48 are not engaged, that is, in a state in which the hopper 32 is held to the feed position, and the sheet P is further fed.

Figure 5C:
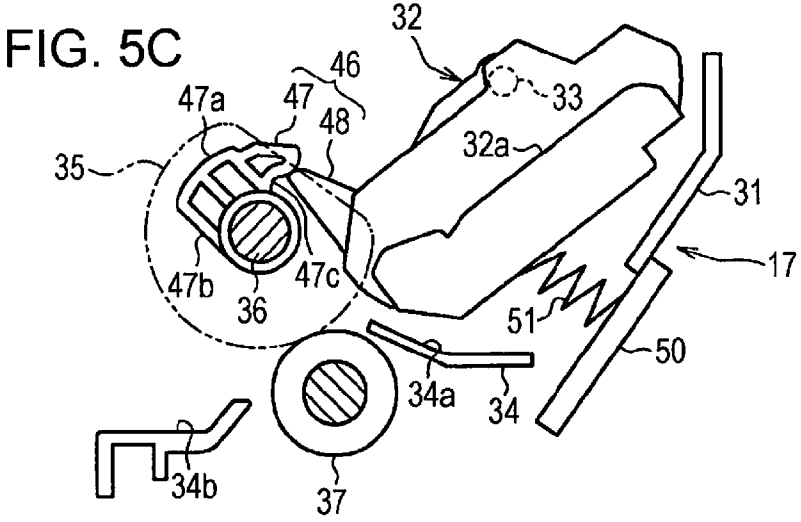
Figure 5D:
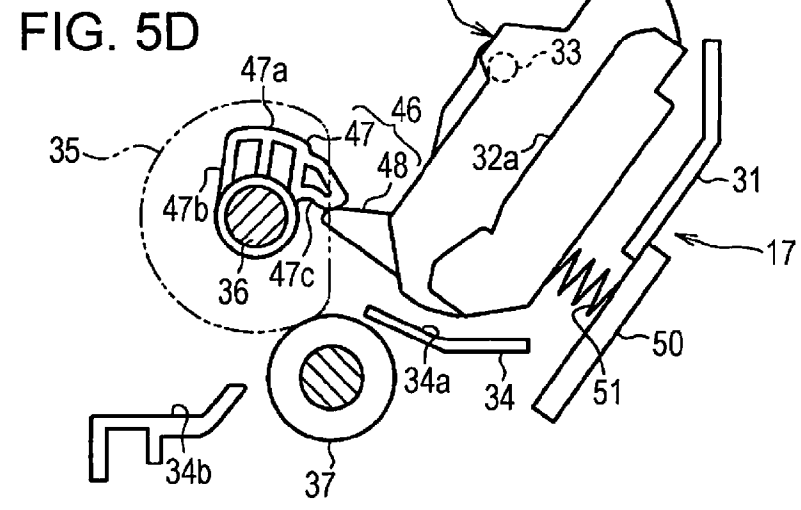

As shown in FIG. 5C, when the rotation amount from the standby position of the feed roller 35 reaches a predetermined amount, the third cam surface 47*c* of the cam 47 strikes the cam follower 48. Thereafter, in a hopper lowering process (hopper retreating process) that is a process in which the rotation of the feed roller 35 proceeds, according to the force with which the cam 47 pushes the cam follower 48, the hopper 32 lowers (retreats) from the feed position (FIG. 5C) to the standby position (FIG. 5D) by resisting the biasing force of the compression spring 51. Even if the hopper lowering process is included, there are still cases where the leading edge of the sheet P does not reach the transport roller pair 53. The reason for this is because there is a tendency for the start timing of feeding to become earlier as the stacking thickness of the sheets P mounted on the hopper 32 increases, and for the start timing of the feeding to become later as the stacking thickness becomes thinner.

In the skew removal operation, a biting operation in which the leading edge of the sheet P is nipped by the transport roller pair 53 in a state where only a predetermined length is projected to the downstream side and a discharging operation in which the leading edge of the sheet P is discharged by reversal of the transport roller pair 53. When nipping of the leading edge of the sheet by the transport roller pair 53 is released and the driving of the first motor 40 is stopped in the process of the discharging operation, the feed roller 35 receives a force in the reverse direction due to the biasing force of the compression spring 51 transferred via the cam mechanism 46. Here, the one-way clutch 43 (refer to FIG. 3) transfers the rotation force in a direction (transport direction) in which the feed roller 35 is forward rotated, and simply by not transferring the rotation force in the reverse direction (reverse transport direction), if an external force such as from the compression spring 51 is applied, the feed roller 35 is able to reverse according to the external force. Therefore, when the sheet is excessively reverse transported by excessive reversal of the feed roller 35, the sheet P is stretched to the upstream side in the transport direction at a part between the feed roller 35 and the transport roller pair 53. In this case, as described above, because problems such as reductions in the skew removing effect and lowering of the cuing position precision, in the embodiment, excessive reversal of the feed roller 35 is controlled according to the motor control.

Figure 6:
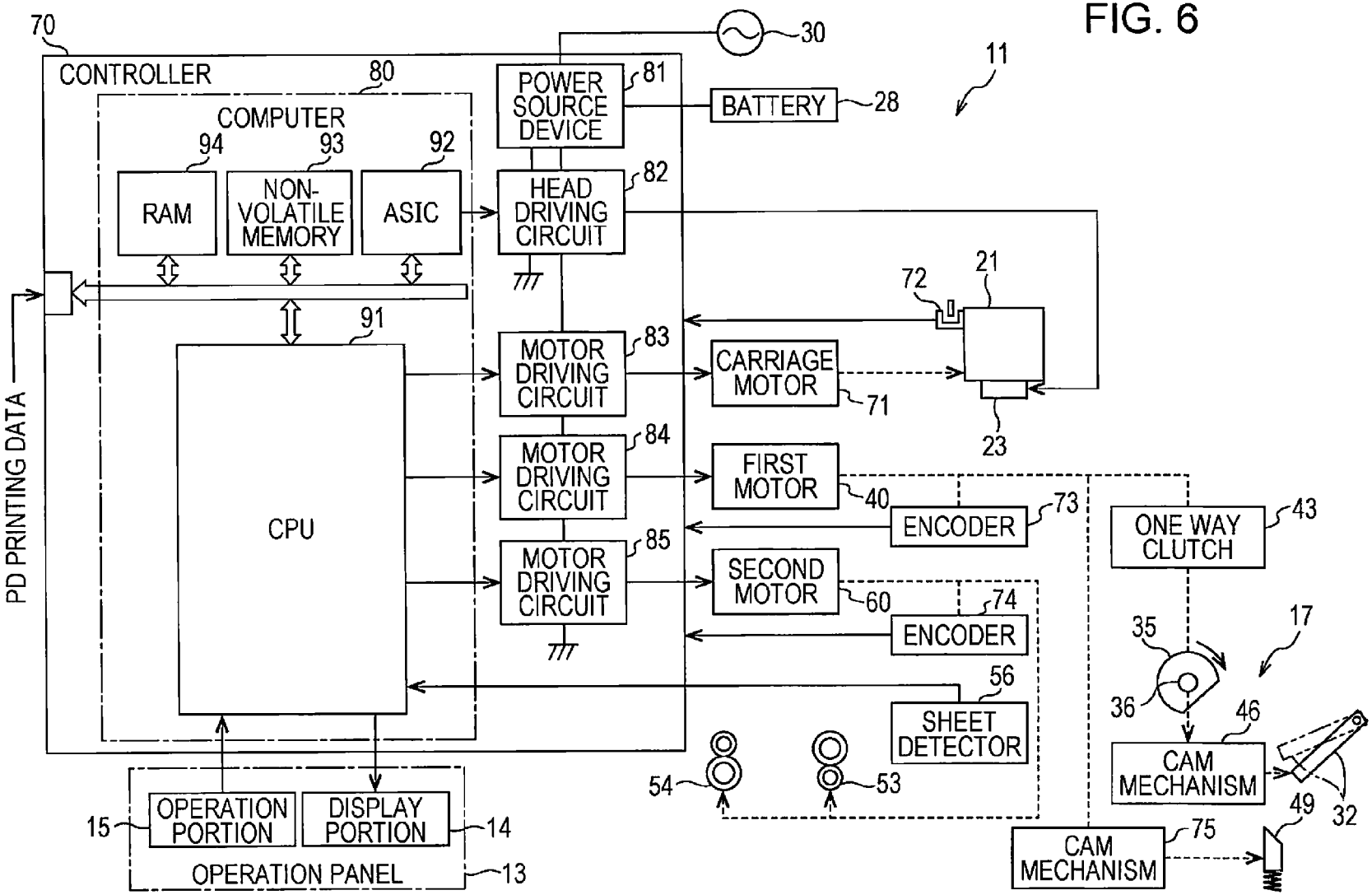
FIG. 6 is a block diagram showing the electrical configuration of a printer.

Next, the electrically configuration of the printer 11 will be described with reference to FIG. 6. As shown in FIG. 6, the recording head 23, the carriage motor 71, the first motor 40 and the second motor 60, as an output system, are electrically connected to the controller 70 as a controller provided in the printer 11. The sheet detector 56, the sheet width sensor 59, the linear encoder 72 and the encoders 73 and 74 (rotary encoders), as an input system, are electrically connected to the controller 70.

The linear encoder 72 outputs the detection pulse signal having a number of pulses compared to the rotation amount of the carriage motor 71. The encoder 73 outputs the detection pulse signal having a number of pulses compared to the rotation amount of the first motor 40. The encoder 74 further outputs the detection pulse signal having a number of pulses compared to the rotation amount of the second motor 60.

The sheet detector 56 detects the leading edge of the sheet P at a predetermined position on the feed path, and the position when the leading edge is detected is used as the origin point when measuring the position (transport position) in the transport direction Y of the sheet P. The measured transport position of the sheet P is used in control of the first motor 40 and the second motor 60 that performed the skew removing operation that removes skew (slant) of the sheet P, described later. The sheet width sensor 59 is provided on the carriage 21 and is a reflection-type optical sensor able to detect the side edge of the sheet P by moving in the X direction while irradiating detection light toward the support stand 55, detection of the width of the sheet P and of the leading edge in the transport direction Y is possible based on the detection signal thereof. In cases where the transport position of the sheet in which the position at which the leading edge is detected by the sheet detector 56 is the origin point, shifts from the actual position of the sheet P due to the subsequent skew removal operation, when cuing of the sheet P is performed based on the transport position thereof, the cuing position precision is lowered. In this case, if cuing is performed with the position at which the leading edge of the sheet P is detected by the sheet width sensor 59 as a standard, the necessary cuing position precision is ensured.

The controller 70 shown in FIG. 6 includes a computer 80, a power source device 81, a head driving circuit 82, and motor driving circuits 83 to 85. The power source device 81 inputs a predetermined voltage of direct current in which alternating current from a commercial AC power source 30 is transformed, rectified or the like via an AC adapter, and supplied each direct current in which a necessary plurality of voltages is transformed to each driving circuit 82 to 85, the display portion 14, a computer 80 or the like. The power source device 81 similarly supplies each direct current in which direct current input from a battery 28 is transformed to a necessary predetermined voltage to each driving circuit 82 to 85 or the like, when the printer 11 has a battery mode.

The computer 80 includes a CPU 91, an application specific IC (ASIC) 92, a nonvolatile memory 93 and a RAM 94. Various programs including a program for feed control indicated by the flowchart in FIG. 11 and necessary setting data or the like are stored in the nonvolatile memory 93. Programs executed by the CPU 91 and data such as various calculation results are temporarily stored in the RAM 94.

The CPU 91 executes programs read out from the nonvolatile memory 93, performs printing control that is the start of feed control performed by the printer 11, and administers control of the printer 11. The CPU 91 controls driving of the carriage motor 71, first motor 40, and second motor 60 via each of the motor driving circuits 83 to 85 during printing control. More specifically, the CPU 91 causes a current to flow to the motors 40, 60, and 71 according to each command value by outputting the respective command values to each motor driving circuit 83 to 85. The command value is output with the pulse width modulation (PWM) signal, and a current flows to each motor 40, 60, and 71 according to the duty ratio of the PWM signal (ratio of the pulse width with respect to the cycle of the PWM signal). The CPU 91 performs various processes based on the operation signal from the operation portion 15, and performs display control in which a menu screen, setting screen and the like are displayed on the display portion 14 via a display driving circuit, not shown.

The ASIC 92 administers the ink ejection control of the recording head 23 by performing data processing in which the necessary head control data in order for the recording head 23 to perform ink ejection is generated from image data included in the printing data PD, and outputting the generated head control data to the head driving circuit 82. The ASIC 92 inputs the detection pulse signal of each encoder 72 to 74, and counts the respective number of pulse edges with three internal counters. Each of the three counters increments the counted value by "1" at a time during forward driving of the motors that are the respective target, and decrements the counted value by "1" at a time during reversal of the motors. That is, the ASIC 92 acquires the count value in which the number of pulse edges of the detection pulse signal from the linear encoder 72 with the internal CR counter (not shown) is counted, and that indicates the position in the direction X of the carriage 21. The ASIC 92 acquires the count value in which the number of pulse edges of the detection pulse signal from the encoder 73 with the internal ASF counter (not shown) is counted, and that indicates the rotation position of the carriage 35. The ASIC 92 further acquires the count value in which the number of pulse edges of the detection pulse signal from the encoder 74 with the internal PF counter (not shown) is counted, and that indicates the transport position of the sheet P in which when the leading edge of the sheet P is detected by the sheet detector 56 is made the origin point.

The CPU 91 performs drive control of the carriage motor 71 and performs speed control and position control of the carriage 21 by outputting the motor command value according to the carriage position ascertained from the counted value of the CR counter to the motor driving circuit 83. The CPU 91 performs drive control of the first motor 40 and feed control of the feed device 17 by outputting the motor command value according to the feed position of the sheet ascertained from the counted value of the ASF counter to the motor driving circuit 84. The feed roller 35 rotates in one direction (feed direction) only according to the power transmitted from the first motor 40 to the rotation shaft 36 via the power transmission mechanism 38 (FIG. 3) including the one-way clutch 43. The hopper 32 moves between the standby position and the feed position through the power in which the rotation of the rotation shaft 36 is converted via the cam mechanism 46. The pair of stoppers 49 (in FIG. 6, only one not shown) moves between the retreated position at which delivery of the sheet P on the hopper 32 is permitted and the standby position at which multiple feeding of the sheet P is stopped by preventing feeding of subsequent sheets P of the one delivered sheet P through the power in which the rotation output from the first motor 40 is converted via the cam mechanism 75.

The CPU 91 further performs drive control of the second motor 60 and transport control of the transport roller pair 53 by outputting the motor command value according to the transport position of the sheet ascertained from the counted value of the PF counter to the motor driving circuit 85. Here, the CPU 91 is able to ascertain the movement amount of the carriage 21 from variations in the counted value of the CR counter, and able to ascertain the reverse transport value to the downstream side in the transport direction of the sheet P and to the upstream side in the transport direction of the sheet P from variations in the counted value of the PF counter. Examples of the host device (not shown) that forwards the printing data PD to the printer 11 include mobile terminals such as smartphones, mobile telephones, table PCs, and mobile information terminals ((personal digital assistants) PDA), in addition to personal computers.

Next, the skew removal control performed during the feeding operation will be described with reference to FIG. 7. The skew removal control is formed from a biting operation, a discharging operation and a re-biting operation. The biting operation is an operation in which the feed roller 35 and the transport roller pair 53 are forward rotated, and the leading edge of the sheet P is nipped (bitten) by the transport roller pair 53 in a state in which a predetermined amount is projected to the downstream side in the transport direction. The discharging operation is an operation in which the leading edge of the sheet P is discharged to the upstream side in the transport direction by the transport roller pair 53 being reversed. The re-biting operation is an operation in which the leading edge of the sheet P is again bitten by the transport roller pair 53 by the transport roller pair 53 being forward rotated.

Figure 7:
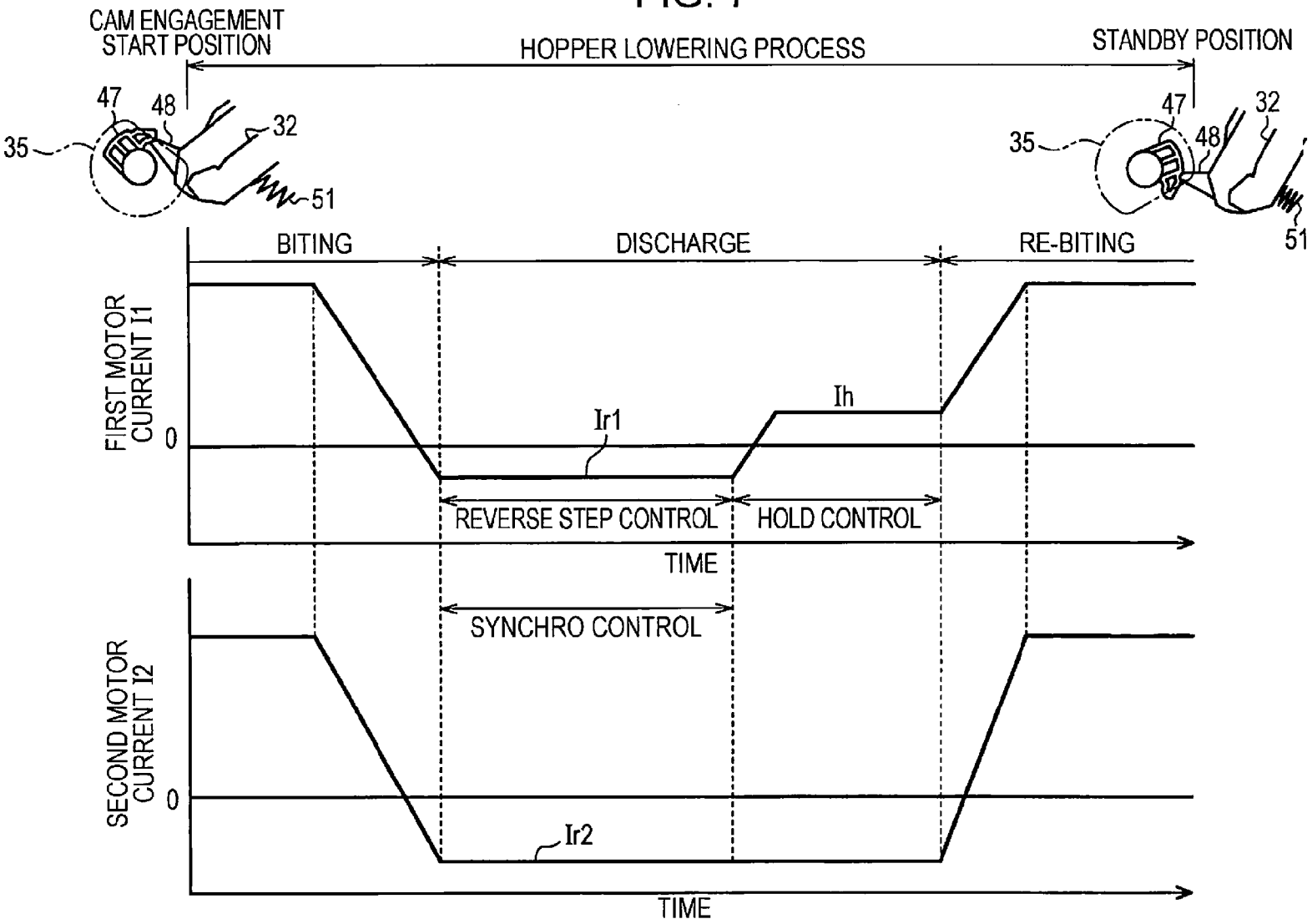
FIG. 7 is a graph showing the current value of a first motor and a current value of the second motor in a skew removal operation.

As shown in FIG. 7, in the process of the biting operation, a positive direction current flows to the first motor 40 and a positive direction current flows to the second motor 60. When the biting operation is finished, the rotation of the feed roller 35 and the transport roller pair 53 is gradually reduced by the motor currents I1 and I2 being gradually reduced. After the forward rotation is stopped, a current with a reverse orientation (negative direction) next flows. The discharge operation is performed by reversing the transport roller pair 53 by a negative orientation current flowing to the second motor 60. At this time, the reverse step control in which the first motor 40 is reversed by the negative orientation reverse current Ir1 flowing to the first motor 40 is performed. Here, the reverse step control is control in which a reverse current Ir1 with a reverse orientation also flows to the first motor 40 between the start of the discharging operation and a predetermined number of steps. The predetermined number of steps corresponds to the number of steps until a biting amount portion of the sheet is discharged in the biting operation, is the number of steps in which it is possible to discharge the entire leading end of the sheet P even if the maximum skew is assumed, and this is the number of steps of the biting amount portion in the biting operation or a value of the number of steps thereof or more. The execution period of the reverse step control maybe at least a portion period of the period in which the sheet P in the execution period of the discharging operation that is an example of the skew removing operation is nipped by the transport roller pair 53.

In the embodiment, synchro control is performed in which the reverse driving of the first motor 40 and the reverse driving of the second motor 60 are synchronized. That is, the computer 80 performs driving control of the first motor 40 and the second motor 60 while obtaining synchronization in which the reverse transport speed V1 (or reverse transport amount) of the sheet P by the feed roller 35 is suppressed to the reverse transport speed V2 (or reverse transport amount) of the sheet P by the transport roller pair 53 or lower. Here, the respective the velocities V1 and V2 of the feed roller 35 and the transport roller pair 53 indicate the medium transport speed at which the medium is able to be transported to the upstream side in the transport direction by reversal of each roller 35 and 53*a*, and is a value in which the peripheral speed of the outer peripheral surface of each roller 35 and 53*a* are compared, with reference to the respective rotation speeds of the rollers 35 and 53*a* and the differences in roller diameter. The reverse transport speeds V1 and V2 indicate the reverse transport amount per unit time. The unit time, for example, is 1 second.

Therefore, in the synchro control, the first motor 40 and the second motor 60 are synchronized and alternately driven in a predetermined cycle. The first motor 40 and second motor 60 are controlled so that the reverse transport speeds do not satisfy the above conditions in the same cycle of the synchro control and the reverse transport speed per unit time (for example, one second) in the discharge operation period that is the average reverse transport speed in a plurality of cycles satisfies the above conditions. That is, the first motor 40 and second motor 60 may be drive controlled so that the reverse transport speed V1 of the feed roller 35 and the reverse transport speed V2 of the transport roller pair 53 are speed controlled with conditions (V1≤V2) at which stretching of the sheet P does not arise at the part between the feed roller 35 and the transport roller pair 53.

Here, the discharging operation of the related art discharges the sheet by reversing the transport roller pair by reverse driving the second motor in the stopped state of the feed roller in which electrical connection with the first motor is cut off. In so doing, bending of the sheet is formed between the transport roller pair and the feed roller, and skew of the sheet P is removed using the recovery force (stiffness of the sheet) of the bending. However, in the embodiment, the discharge operation is performed in the hopper lowering region (hopper retreat region). When the first motor is in a stop state in which electrical connection is cut off, the feed roller 35 suddenly greatly reversely rotates due to the biasing force of the compression spring 51 of the hopper 32, the sheet P is greatly reversely transported and stretched to the upstream side in the transport direction, thereby eliminating bending, and the leading edge of the sheet is separated from the nip point of the transport roller pair 53 to the upstream side in the transport direction. Thus, skew removal using the recovery force (stiffness) of the bending of the sheet P is not suitably performed, and the skew removal effect is greatly reduced.

Thus, in the embodiment, a suppression current that suppresses excessive reversal of the feed roller 35 caused by the biasing force of the compression spring 51 flows to the first motor 40 in the discharging operation process. As an example thereof, the hold current Ih flows to the first motor 40 in the discharging process and holds the first motor 40 in the stopped state. Therefore, even if the force in the reverse direction acts on the rotation shaft 36 by the biasing force of the compression spring 51 of hopper 32, the feed roller 35 is held in a substantially stopped state by the connection of the hold current Ih to the first motor 40, and even if temporarily reversed, the feed roller 35 is suppressed to a low reverse transport speed of the reverse transport speed or lower due to the transport roller pair 53. Therefore, in the discharging operation, the sheet P being reverse transported by the feed roller 35 at a larger reverse transport amount than the reverse transport amount of the transport roller pair 53 is eliminated, and there is no stretching to the upstream side in the transport direction in a state where the sheet P has no bending. In so doing, bending of the sheet P between the feed roller 35 and the transport roller pair 53 is formed, and it is possible for skew of the sheet P to be removed using the recovery force (stiffness of the sheet) of the bending. When the hold current Ih flows to the first motor 40, the reverse transport speed V1 of the feed roller 35 basically becomes zero, and the condition V1≤V2 is achieved.

Figure 9:
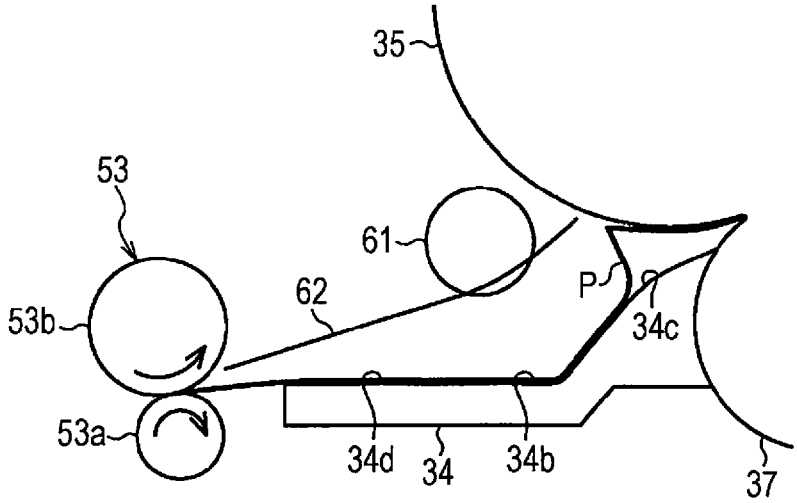
FIG. 9 is a schematic side view describing a problem point in a case where the bending amount of a sheet between the feed roller and a transport roller pair is excessive.
Figure 10:
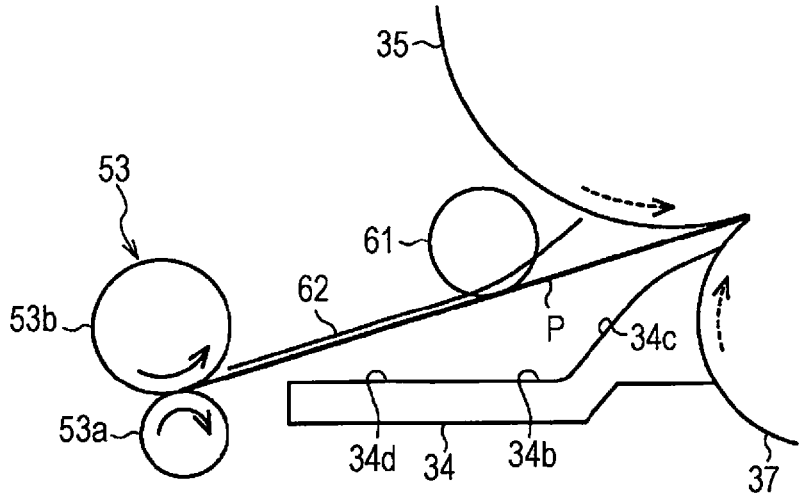
FIG. 10 is a schematic side view showing the skew removal operation in which the bending amount of a sheet between the feed roller and the transport roller pair is appropriately controlled.

On the other hand, as shown in FIGS. 9 and 10, in the printer 11 of the embodiment, the transport space of the sheet P between the nip point of the feed roller 35 and the retard roller 37 and the nip point of the transport roller pair 53 is comparatively narrow. As shown in FIGS. 9 and 10, the medium guide portion 34*b* includes an inclined portion 34*c* that lowers from the nip position of the feed roller 35 and the retard roller 37 along the downstream side in the feed direction and a flat portion 34*d* that extends substantially horizontally connected to the downstream side in the feed direction of the inclined portion 34*c*. A guide roller 61 and a medium guide plate 62 are provided at positions (upper side in FIGS. 9 and 10) on the opposite side with respect to the medium guide portion 34*b* with the medium feed path interposed. As shown in FIG. 9, in a case where bending of the sheet P is formed by the discharging operation, when the part at which the sheet P is bent becomes longer than the length along the upper surface of the flat portion 34*d* and the inclined portion 34*c* of the guide formation member 34, folding easily arises in the sheet P as shown in FIG. 9.

In each embodiment, as shown in FIG. 10, the first motor 40 is reverse driven by performing the reverse step control in which the reverse current Ir1 (refer to FIG. 7) flows to the first motor 40 in the entire or a part of the period in which the leading edge of the sheet P is nipped by the transport roller pair 53 in the discharging operation. However, even if the first motor 40 is reverse driven, because the transmission of power in the reverse direction is regulated by the one-way clutch 43, the feed roller 35 does not reverse. With only the recovery force (stiffness) of slight bending by which the sheet P being reversed by the reversal of the transport roller pair 53, it is difficult for the feed roller 35 on which there is a load from the one-way clutch 43 to be reversed. Thus, by reverse driving the first motor 40 and applying a force in the reverse direction thereof to the one-way clutch 43, the load is reduced when the feed roller 35 is reversed. That is, the load is reduced by a force in the reverse direction being generated on the output shaft of the first motor 40 by the reverse current Ir1 flowing to the first motor 40, and the force in the reverse direction being applied to the one-way clutch 43, and reversal of the feed roller 35 is assisted through the recovery force (stiffness) of the bending of the sheet P.

The synchro control shown in FIG. 7 may be performed a fixed reverse current Ir1 continuously flowing to the first motor 40, or may be performed by the reverse current Ir1 intermittently flowing. In the embodiment, as an example, synchro control is performed by the reverse current Ir2 able drive in the reverse direction intermittently flows to the second motor 60, and the reverse current Ir1 intermittently flowing to the first motor 40 flowing thereto. In the synchro control, bending forming driving in which bending of the sheet P is formed at the part between the feed roller 35 and the transport roller pair 53 is performed by, first, only the second motor 60 is reverse driven, the sheet P is reverse transported by the transport roller pair 53 being reversed with the feed roller 35 in a stopped state. Next, bending resolution driving that resolves the bending of the sheet P is performed by the feed roller 35 being reversed according to the recovery force of the bending of the sheet P by only the first motor 40 being reverse driven, and the load being reduced by applying the force in the reverse direction to the one-way clutch 43. The synchro control is performed by alternately repeating the bending forming driving by the transport roller pair 53 based on the reverse driving of the second motor 60 and the bending resolution driving by the feed roller 35 based on the reverse driving of the first motor 40.

At this time, the controller 70 speeds and slows the reversal speed of the first motor 40 by repeating the variations in the current value in which the reverse current Ir1 that flows to the first motor 40 is periodically increased and decreased a plurality of times. In this case, in the graph of FIG. 7, in the execution period of the synchro control, the reverse current Ir1 of the first motor 40 and the reverse current Ir2 of the second motor 60 are the pulse currents that are strictly shifted by a half cycle from one another. At this time, since the cycle for each half cycle in which the reverse current Ir1 flows is an extremely short time, the reversal of the feed roller 35 is suppressed by the biasing force of the compression spring 51. The hold current Ih may flow in the period for each half cycle in which the reverse current Ir1 does not flow. The frequency of pulse current in which the reverse currents Ir1 and Ir2 are alternately connected in the execution period of the synchro control is a predetermined Hz within a range of 10 to 100 Hz, as an example. The frequency of the pulse current of the synchro control may be less than 10 Hz or may exceed 100 Hz. However, the cycle of the pulse current of the synchro control is longer than the PWM cycle when the computer 80 controls motor driving circuits 84 and 85 corresponding to the respective motors 40 and 60, and a plurality of PWM signals from one cycle of the pulse current of the synchro control is output to the motor driving circuits 84 and 85.

Next, the skew removal operation performed during the feeding process in order to remove skew (slant) in which the sheet P is obliquely inclined with respect to the transport path will be described with reference to FIGS. 8A to 8H. In the embodiment, at least a biting and discharge method of skew removal operation is employed. The skew removal control is formed from three operations of a biting operation, a discharging operation and a re-biting operation.

Figure 8A:
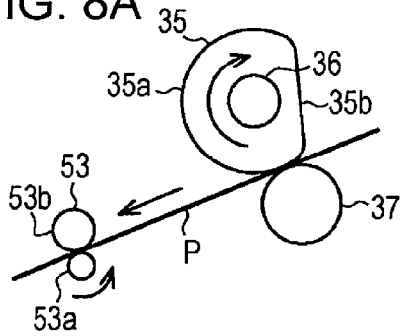
FIGS. 8A, 8C, 8E, and 8G are schematic side views showing the skew removal operation of a biting and discharging method.
Figure 8B:
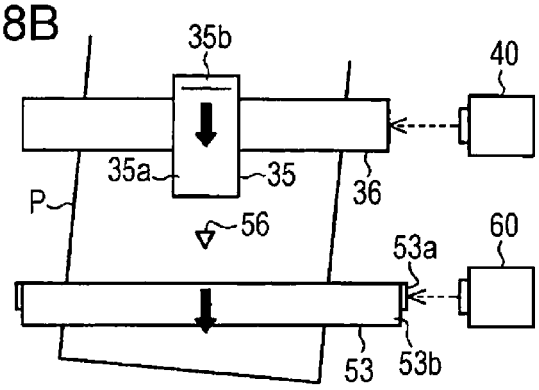
FIGS. 8B, 8D, 8F, and 8H are schematic plan views of the same.

As shown in FIGS. 8A and 8B, in the case of a biting and discharging method, the biting operation is performed in which the sheet P is transported to a position projected by a predetermined length (biting amount) from the transport roller pair 53 to the downstream side in the transport direction Y. Specifically, first, by the feed roller 35 and the transport roller pair 53 being forward rotated by the first motor 40 and second motor 60 being forward driven, the sheet P is fed in the delivery direction. When the leading edge of the sheet P reaches before the transport roller pair 53 and is detected by the sheet detector 56, the PF counter counts the transport position of the sheet P with the detection position as the origin point. The leading edge of the sheet P is stopped once motors 40 and 60 are driven by the number of steps corresponding to the biting amount from the nip position of the transport roller pair 53 according to the counted value of the PF counter. In this way, the biting operation is performed.

Figure 8C:
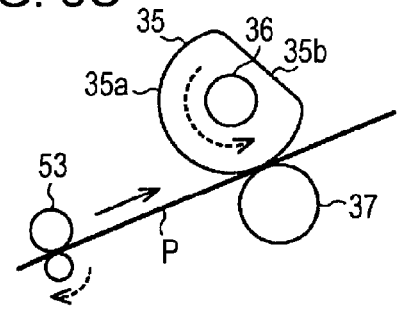
Figure 8D:
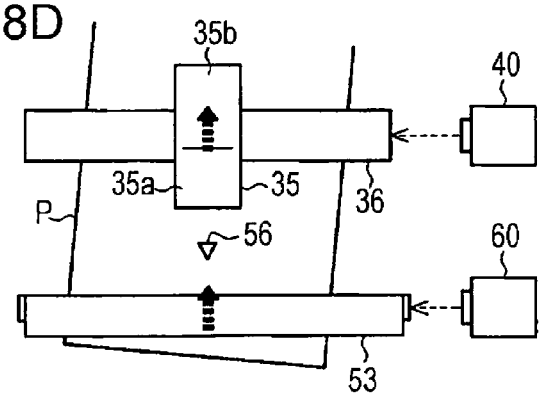

Next, as shown in FIGS. 8C and 8D, the transport roller pair 53 is reversed, thereby discharging the sheet P to the upstream side in the transport direction. First, synchro control is performed in which the first motor 40 and second motor 60 are synchronized and reversed driven by the predetermined number of steps, and the feed roller 35 and the transport roller pair 53 are synchronized and reversed in order to the adjust the bending amount to be small. In the synchro control, the reverse transport speed V1 (or reverse transport amount) of the feed roller 35 is suppressed to the reverse transport speed V2 (or reverse transport amount) of the transport roller pair 53 or less. In FIGS. 8A to 8H, as an example, the reverse transport speed V1 of the feed roller 35 and the reverse transport speed V2 of the transport roller pair 53 are the same.

In the synchro control of the embodiment, since the first motor 40 and the second motor 60 are alternately driven with a predetermined cycle, the bending forming driving by the transport roller pair 53 and the bending resolution driving by the feed roller 35 are alternately repeated. At this time, by a force in the reverse direction being applied to the one-way clutch 43 by the reverse driving of the first motor 40, reversal of the feed roller 35 in which the load of the one-way clutch 43 is reduced and the recovery force of the bending of the sheet P is used is assisted. In the synchro control in this way, since the bending forming driving and the bending resolution driving are alternately performed, bending of the sheet P between the feed roller 35 and the transport roller pair 53 does not substantially occur. The skew of the sheet is gradually removed with the state in which the leading end of the sheet P is nipped by the transport roller pair 53 as is.

Figure 8E:
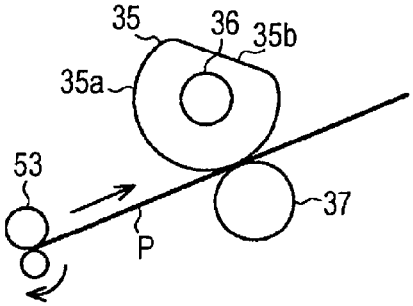
Figure 8F:
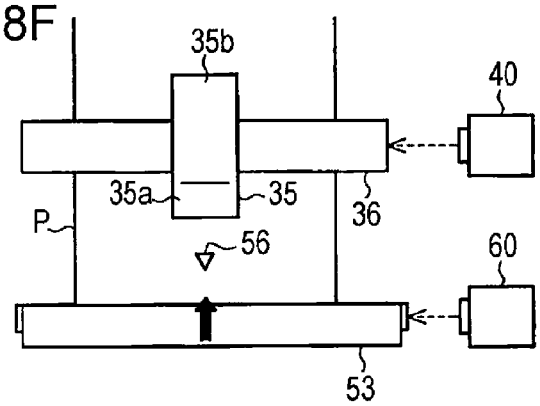

In the example in FIGS. 8A to 8H, the predetermined number of steps is set to a value corresponding to the biting amount, and the sheet P is reverse transported until the nipping of the transport roller pair 53 is released, as shown in FIGS. 8E and 8F according to the synchro control. If the bending amount is the permitted amount in which folding does not occur shown in FIG. 9, the bending forming driving and the bending resolution driving maybe performed one at a time. The bending forming driving and the bending resolution driving may be performed at the same time, and the control in which these are repeated may be performed.

By the bending forming driving and the bending resolution driving being performed one or a plurality of times in this way, skew is removed by the sheet P rotating with the nip point of the feed roller 35 as a center. Since there is substantially no bending amount of the sheet P as shown in FIG. 10, there is no concern of the sheet P incurring damage such as folding caused by an excessive bending amount as shown in FIG. 9.

Next, as shown in FIGS. 8E and 8F, the second motor 60 is reverse driven with the first motor 40 in a stopped state. In the discharging operation, even when the skew is the maximum, a discharging amount able to discharge the sheet P from the transport roller pair 53 is set, and only the transport roller pair 53 is reverse driven for a while even if the nipping of the sheet P is released. Although the skew is substantially removed with the process of synchro control, by the sheet being discharged from the transport roller pair 53 with the feed roller 35 in a stopped state, if bending is formed at this state, the leading edge of the sheet P is not at the nip point of the transport roller pair 53 with the recovery force by which the bend sheet P tends to return, and the skew of the sheet P is further removed.

Figure 8G:
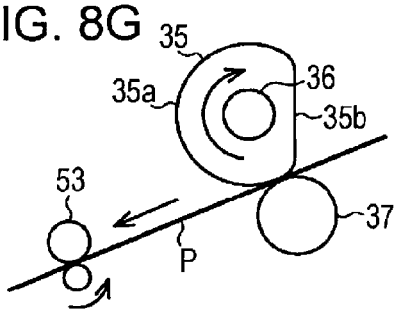
Figure 8H:
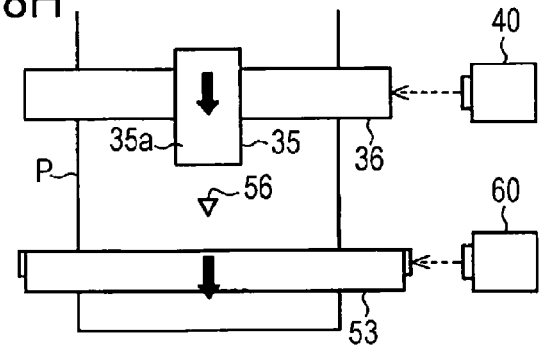

When the discharging operation is finished, as shown in FIGS. 8G and 8H, the re-biting operation is performed. That is, the first motor 40 and second motor 60 are forward driven, the re-biting operation is started according to the forward rotation of the feed roller 35 and the forward rotation of the transport roller pair 53, and the sheet P is transported to a re-biting position projected by a predetermined amount to the downstream side in the transport direction by the nip position by the nip position of the transport roller pair 53. Thereafter, the sheet P is further transported to the downstream side by the forward rotation of the transport roller pair 53, and cued to the printing start position.

Next, the action of the printer 11 will be described.

Figure 11:
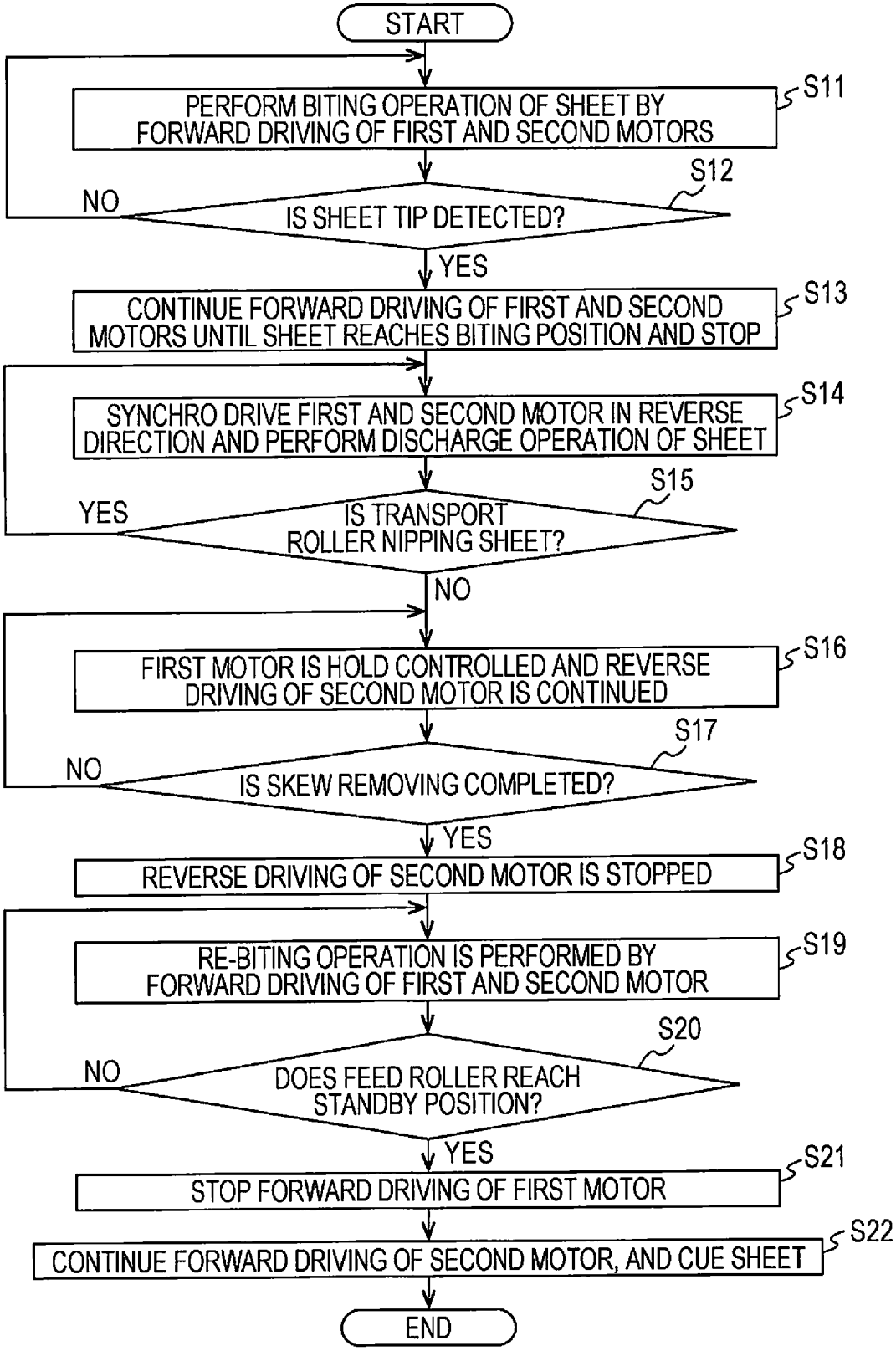
FIG. 11 is a flowchart showing the feed control accompanying the skew removal operation of a biting and discharge method.

The feed control will be described with reference to the flowchart shown in FIG. 11. When the printing start command is received reception of printing data PD or operation of the operation portion 15, the computer 80 starts the following feed control. In the feed control, the feed speed and the skew removal method are determined according to the mode (power source mode and printing mode) at this time. For example, if the biting and discharging method is the selected method, the feed control that accompanies the skew removal according to the biting and discharging method shown in FIGS. 8A to 8H is performed.

In Step S11, the first and second motors are forward driven, and the biting operation of the sheet is performed.

In step S12, it is determined whether or not the leading edge of the sheet is detected. If the leading edge of the sheet is detected by the sheet detector 56, the process proceeds to step S13, and if the leading edge of the sheet is not detected, the process returns to step S11. During execution of the biting operation, when the leading edge of the sheet is detected (positive determination in S12), the process proceeds to step S13.

In step S13, forward driving of the first and second motors continues until the sheet reaches the biting position and stops. From the point at which the leading edge of the sheet is detected by the sheet detector 56, the number of steps is obtained for each motor 40 and 60 according to the biting amount according to the size and paper type of the sheet at this time. When the first motor 40 and second motor 60 are forward driven by the respective number of steps from the point in time of detection of the leading edge of the sheet by the sheet detector 56, the driving of each motor 40 and 60 is stopped.

In step S14, the first and second motors are synchro driven in the reverse direction and the discharging operation of the sheet is performed. Here, in the synchro control, not only the second motor is revere driven, but also the first motor is reverse driven. The transport distance L1 of the sheet P by the reverse driving of the first motor 40 is set to the reverse transport distance L2 of the sheet by the reverse driving of the second motor 60 or less (L1≤L2). The first motor 40 and the second motor 60 are synchronized and reverse driven so that the transport conditions (L1≤L2) are satisfied during discharging. In the embodiment, synchro control is performed in conditions in which L1=L2 is satisfied. That is, the second motor 60 and the first motor 40 are alternately driven from the biting operation finish position. At this time, first, by the second motor 60 being reverse driven by the driving amount of the reverse transport distance L2, the sheet P is reverse transported by the reverse transport distance L2 by the transport roller pair 53, and, in so doing, slight bending arises at a part of the sheet P between the transport roller pair 53 and the feed roller 35. Next, the first motor 40 is reverse driven for a predetermined time in which the feed roller 35 is able to be reversed by the reverse transport distance L1 with the force of the stiffness due to the bending of the sheet P. By a force in the reverse direction being applied to the one-way clutch 43 by the reverse driving of the first motor 40 and the load on the one-way clutch 43 being reduced, reversal of the feed roller 35 due to the recovery force of the bending of the sheet P is assisted. As a result, the feed roller 35 is reversed by the recovery force of the bending of the sheet P, and the sheet P is reverse transported by the reverse transport distance L1. The first motor 40 and second motor 60 are alternately reverse driven while satisfying the above reverse transport conditions. As a result, by the forming of the bending of the sheet P and the resolution of the bending being alternately repeated at a part of the sheet P between the feed roller 35 and the transport roller pair 53, the posture of the sheet P is gradually rotated with the contact location with the feed roller 35 as a center, and the skew is gradually removed.

In step S15, it is determined whether or not the transport roller nips the sheet. If the transport roller nips the sheet, the process returns to step S14, and when the transport roller does not nip the sheet, the process proceeds to step S16. In this way, the synchro control is performed until the nipping of the transport roller pair 53 is released. In the above description, in step S14, although synchro control is performed in conditions in which L1=L2 is satisfied, it is also possible for synchro control to be performed in conditions in which L1<L2 is satisfied. In this case, although bending of the sheet P between the feed roller 35 and the transport roller pair 53 is gradually accumulated by the reverse driving of the first motor 40 and the second motor 60 being repeatedly performed, folding does not occur because it is possible for the occurrence of folding to be more reduced than the bending amount shown in FIG. 9. Because the sheet P is discharged in a state in which there is bending between the feed roller 35 and the transport roller pair 53, skew removal is possible using the force (stiffness) that tends to resolve the bending of the sheet P when discharged. In the example, although a configuration in which the driving of the first motor 40 and the second motor 60 are alternately repeated, even in a case in which the first motor 40 and the second motor 60 are synchronized and reverse driven at the same time so that the reverse transport conditions (L1≤L2) are satisfied, it is possible to perform skew removal while similarly reducing the bending amount. In these cases, when the nipping of the sheet P by the transport roller pair 53 is released, the process proceeds to step S16.

In step S16, the first motor is hold controlled, and the reverse driving of the second motor continues. That is, hold control that holds the first motor 40 in the stopped state is performed by the hold current Ih flowing to the first motor 40. As a result, even through the driving of the first motor 40 is stopped, reversal of the feed roller 35 is suppressed even in a state in which the rotation shaft 36 receives a force in the reverse direction due to the biasing force of the compression spring 51 of the hopper 32 partway through the retreat operation (lowering operation) of the hopper 32 by the engagement of the cam 47 and the cam follower 48. Thus, reverse driving of the transport roller pair 53 is performed in a state in which the feed roller 35 in which the reversal is suppressed is held in the stopped state. Thus when the reversal of the transport roller pair 53 continues for a while once the sheet P is discharged from the transport roller pair 53, even if the driving of the first motor 40 is stopped, the feed roller 35 reversing according to the biasing force of the compression spring 51 of the hopper 32 is avoided. As a result, the transport roller pair 53 reverses only with the sheet P held at the position discharged from the transport roller pair. Therefore, the cause of the sheet P being further reverse transported to the upstream side in the transport direction by reversal of the feed roller 35 due to the biasing force of the compression spring 51, and the cuing position precision thereafter being lowered is avoided.

In step S17, it is determined whether or not the skew removal is completed. That is, it is determined whether or not the second motor 60 reaches the number of reverse steps for discharging. If the skew removal is completed, the process proceeds to step S18, and if the skew removal is not completed, the process returns to step S16. The reversal of the transport roller pair 53 is continued until the discharge operation completes by the reaching the number of reversal steps for discharging, and when the discharging operation completes by reaching the number of reversal steps for discharging, the process proceeds to step S18.

In step S18, reverse driving of the second motor is stopped. The reversal of the transport roller pair 53 is stopped by the reverse driving of the second motor 60 being stopped, and the skew removal operation is finished.

In step S19, the first and second motors are forward driven, and the re-biting operation is performed. That is, the first motor 40 and second motor 60 being forward driven, the re-biting operation in which the leading end of the sheet P temporarily discharged is nipped again by the transport roller pair 53 is performed. The re-biting operation is a portion of the cuing operation, and in the example, the operation in the process of again being nipped by the transport roller pair 53 that is a process from the cuing operation in which feeding is performed by the feed roller 35 is referred to as the re-biting operation.

In step S20, it is determined whether or not the feed roller reaches the standby position. The rotation position of the feed roller is ascertained based on the value of the ASF counter in which the number of pulse edges of the detection pulse signal of the number of the pulses according to the rotation amount of the first motor 40 is counted. When the value of the ASF counter reaches the value corresponding to the standby position, it is determined that the feed roller 35 reaches the standby position. If the feed roller 35 reaches the standby position, the process proceeds to step S21, and if the feed roller 35 does not reach the standby position, the process returns to step S19, and the re-biting operation in step S19 continues.

In step S21, forward driving of the first motor is stopped. That is, the feed roller 35 is stopped at the standby position by forward driving of the first motor 40 being stopped. When the feed roller 35 returns to the standby position by rotating once, the feed roller 35 stops at the standby position at a timing slightly before the stopping of driving of the first motor by the trigger lever 45 engaging with the one-way clutch 43, thereby cutting off the transmission of the power of the first motor 40 to the rotation shaft 36.

In step S22, the forward driving of the second motor continues, and the sheet is cued. That is, the forward driving of the second motor 60 continues, and the sheet P is transported to the cuing position (printing start position). Here, when the value of the PF counter that counts the value of the transport position of the sheet P in which the position when the leading edge of the sheet is detected by the sheet detector 56 is made the reference (zero (0)) reaches the value corresponding to the cuing position, the forward driving of the second motor 60 is stopped. As a result, the sheet P is cued to the printing start position.

According to the embodiment described in detail above, it is possible for the effects shown below to be obtained.

(1) In at least a part of the skew removal operation period (discharging operation period), the controller 70 causes the reverse current Ir1 and the hold current Ih to be switched and flow as a suppression current that suppresses the reverse transport speed of the feed roller 35 to the reverse transport speed of the transport roller pair 53 or less with respect to the first motor 40. Through the electrical connection of the reverse current Ir1 and the hold current Ih to the first motor 40, because the reverse transport amount of the feed roller 35 is suppressed to the reverse transport amount of the transport roller pair 53 or less, and the excessive reversal of the feed roller 35 is suppressed, it is difficult for the sheet P to be stretched to the upstream side in the transport direction at the part between the feed roller 35 and the transport roller pair 53. In the stopped state in which the electrical connection of the first motor is cut off, the first motor is easily reversed by an external force, and the force that suppresses the reversal of the feed roller is weakened. In this case, there is concern of the feed roller excessively reversing, and a larger force in the reverse direction being applied to the feed roller in a state in which the sheet is nipped by the transport roller pair according to the biasing force of the compression spring of the hopper. In this case, skew removal is not appropriately performed by the medium being stretched to the upstream side in the transport direction at a part between the first roller and the second roller. In contrast, according to the embodiment, excessive reversal and the like of the feed roller 35 is suppressed by the suppression currents Ir1 and Ih flowing to the first motor 40. Thus, it is possible for skew removal of the sheet P to be appropriately performed in which the sheet P is reverse transported by at least the transport roller pair 53 from the feed roller 35 and the transport roller pair 53 being reversed. Since a braking unit for recording in JP-A-2007-84224 is not provided, it is possible to avoid the structure increasing in complexity while being possible to contribute a size decrease in the feed device 17 and the printer 11.

(2) In at least a part of the skew removal operation period, because the hold current Ih that holds the first motor 40 in the stopped state flows to the first motor 40, the feed roller 35 is held in the stopped state (that is, the reverse transport speed and reverse transport amount are both zero). Thus, it is possible to appropriately perform the skew removal of the sheet P.

(3) In at least a part of the skew removal operation period, the reverse current Ir1 flows to the first motor 40, and the feed roller 35 reverses by a reverse transport amount of the reverse transport amount of the transport roller pair 53 or less. Thus, when the biasing force of the compression spring 51 of the hopper 32 is applied to the rotation shaft 36 via the cam mechanism 46, it is possible to suppress the sheet P being stretched in which the feed roller 35 is excessively reversed by a greater reverse transport amount than the reverse transport amount of the transport roller pair 53. Accordingly, it is possible for skew removal of the sheet P to be appropriately performed while suppressing the bending amount of the sheet P formed between the feed roller 35 and the transport roller pair 53 to be short.

(4) In at least a part of the skew removal operation period, the feed roller 35 is reversed using the recovery force (force of stiffness) that tends to resolve the bending of the sheet P formed with the feed roller 35 by the transport roller pair 53 reversing the sheet P. The controller 70 assists the reversal of the feed roller 35 due to the recovery force of the bending of the sheet P, by the reverse current Ir1 flowing to the first motor 40. Therefore, it is possible for the feed roller 35 to be reversed using the recovery force due to the bending formed by the reversal of the transport roller pair 53. Thus, it is possible for skew removal of the sheet P to be appropriately performed while suppressing the bending amount of the sheet P formed between the feed roller 35 and the transport roller pair 53 to be short in the process of the skew removal operation.

(5) The feed device 17 includes a hopper 32 provided to be displaceable in a state in which the sheet P before feeding is mounted and biased by the compression spring 51 (example of an elastic member) in a direction approaching the feed roller 35. The rotation shaft 36 of the feed roller 35 is interlinked to operate with the hopper 32 via the cam mechanism 46, and the hopper 32 is operated by resisting the biasing force of the compression spring 51 (example of the elastic member) via the cam mechanism 46 in a rotation region of the feed roller 35 in which skew removal is performed. Thus, in at least a part of the skew removal operation period, even if a biasing force due to the compression spring 51 is applied to the feed roller 35, it is possible for the feed roller 35 to be suppressed from reversing at a greater excess reverse transport amount than the reverse transport amount of the transport roller pair 53. Accordingly, it is possible for the skew removal to be appropriately performed.

(6) The feed roller 35 is interlinked to the first motor 40 to be able to transmit force via the one-way clutch 43, and the first motor 40 is reverse driven matching the reverse driving of the second motor 60, in at least a part of the skew removal operation period. Thus, it is possible for skew removal of the sheet P to be appropriately performed while suppressing folding due to excessive bending of the sheet P between the feed roller 35 and the transport roller pair 53. It is possible to reduce the load by a force in the reverse direction being applied to the one-way clutch 43 by the first motor 40 being reversed driven and to assist reversal of the feed roller 35 due to the recovery force of the bending of the sheet P. Thus, the bending is resolved, and there is no concern of damage such as folding due to formation of an excessive bending amount impacting the sheet P.

(7) In at least a part of the period in which the sheet P is nipped by the transport roller pair 53 in the skew removal operation period, the first motor 40 is reverse driven, and thereafter, the hold current Ih flows to the first motor 40 in at least the period in which the sheet P is not nipped by the transport roller pair 53. Thus, in at least a part of the skew removal operation period, it is possible to appropriately perform the skew removal operation while suppressing excessive amounts of bending by the feed roller 35 being reversed while suppressing excessive reversal.

(8) The controller 70 performs synchro control by advancing and delaying the reversal speed by repeating the variations in the current value in which the reverse current of the first motor 40 is increased and decreased a plurality of times in at least a part of the skew removal operation period. Thus, it is possible to perform formation of bending of the sheet P and reversal of the feed roller 35 due to the recovery force (force of the stiffness) of the bending of the sheet P, and it is possible to avoid the occurrence of folding or the like in the sheet P that causes an excessive bending amount of the sheet P between the feed roller 35 and the transport roller pair 53. Since reverse driving of the second motor 60 and reverse driving of the first motor 40 are alternately repeatedly performed, it is possible to perform the skew removal operation in a state with substantially no bending amount.

(9) The printer 11 includes a feed device 17, and a recording head 23 that executes recording on the sheet P fed by the feed device 17. In the feeding process of the sheet P by the feed device 17, it is possible for skew removal of the sheet P to be appropriately performed in which the sheet P is reverse transported by the transport roller pair 53 being reversed. As a result, printing by the recording head 23 is performed on the sheet P without skew, and a printed matter is provided with little position shifting with respect to the sheet P.

It is possible for the embodiments to be modified in the modes as below.

Figure 12A:
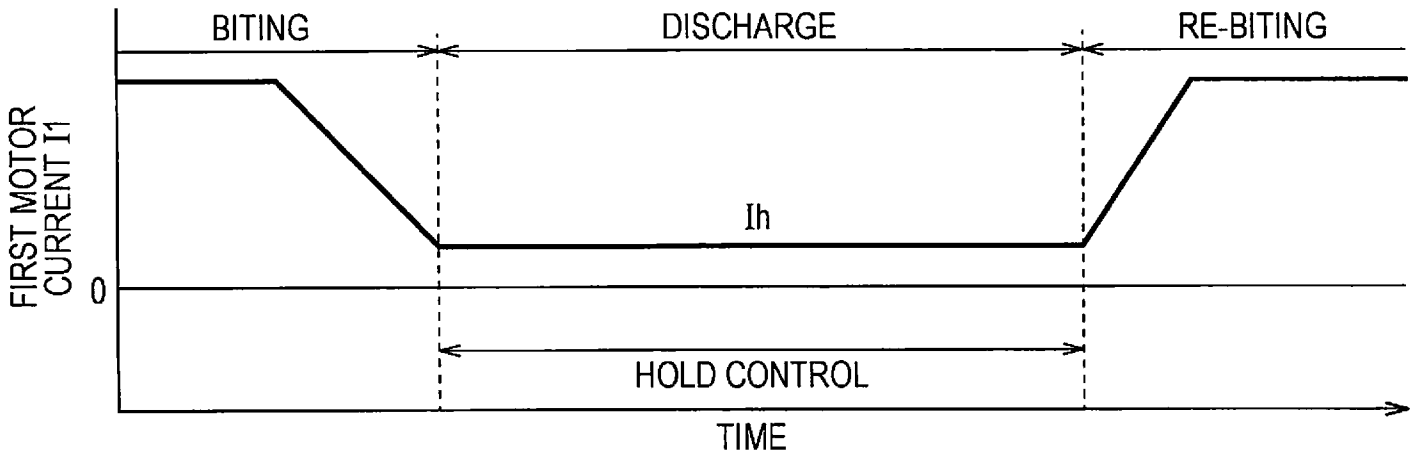
FIG. 12A is a graph showing the current value of the first motor in the skew removal operation of a modification example.
Figure 12B:
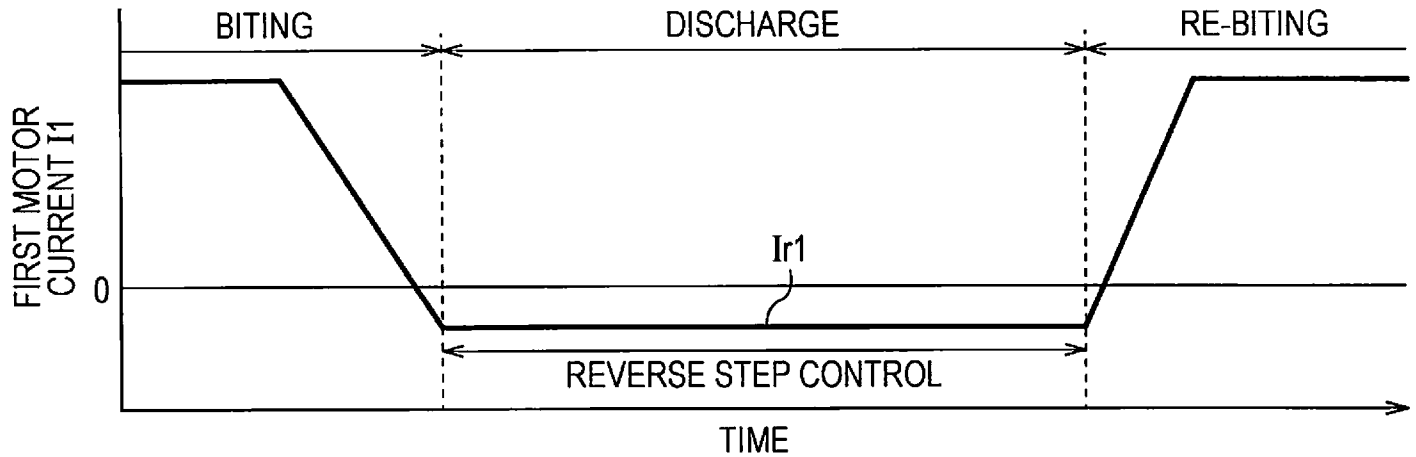
FIG. 12B is a graph showing the current value of the first motor in the skew removal operation of a different modification example to FIG. 12A.

As shown in FIG. 12A, hold control in which the reverse step control of the first motor 40 in the embodiment is replaced with the hold control and a hold current Ih as an example of a suppression current flows in the entire region of the discharging operation period may be performed. Conversely, as shown in FIG. 12B, reverse step control in which the hold control of the first motor 40 in the embodiment is replaced with the reverse step control and a reverse current Ir1 as an example of a suppression current flows in the entire region of the discharging operation period may be performed. In this case, the period in which the reverse current Ir1 flows, is not limited to the entire period in which the sheet P is nipped by the transport roller pair in the skew removal operation period, and may be a part thereof.

In the hold control, although the hold current Ih (>0) flows to the first motor 40, the hold current maybe set to "0 (zero)" (Ih=0) by making the duty value "0%" after closing the circuit so that the hold current Ih flows. According to the configuration, since the control force works by a counter electromotive force generated by the rotation being input to the first motor 40 when the feed roller 35 receiving the force by which the hopper 32 is moved to the rising side with the biasing force of the compression spring 51 via the cam mechanism 46 is reversed, it is possible to suppress the reversal of the feed roller 35 to be small. By closing the circuit in this way, the induction current generated in the first motor according to the reversal of the feed roller 35 may be a suppression current.

In addition to the biting and discharging method, other skew removal methods may be employed. For example, a reverse butting method in which the medium fed by the feed roller 35 being forward rotated butts on the reversed transport roller pair 53 may be employed. A butting method in which the medium fed by the feed roller 35 being forward rotated butts on the transport roller pair 53 in a stopped state may be employed.

The force that works on and reverses the feed roller 35 as an example of a first roller is not limited to a biasing force due to a spring (example of the elastic member) of the hopper. A configuration may be employed in which the biasing force of another member other than the hopper works on the feed roller. That is, if the biasing force that biases a member that is a member driven via the cam mechanism having a cam that rotates interlinked with the rotation shaft of the feed roller in one direction has a configuration that acts as a force in the reverse direction of the first roller in at least a part of the skew removal operation period, the member may be another member other than the hopper.

A configuration may be employed in which the feed roller 35 as an example of the first roller does not receive the biasing force. In a case where the medium reverse transported by the second roller have a comparatively high rigidity, such as a thick paper, there may be cases where the first roller excessively rotates by receiving a comparatively strong reverse transport force from the medium. Excessive reversal of the first roller due to this kind of reverse transport force being received from the medium is also a cause that interferes with the appropriate skew removal. Even in such a configuration, by the suppression current (hold current Ih or reverse current Ir1) flowing to the first motor, since excessive reversal of the first roller is suppressed, it is possible to appropriately perform skew removal on the medium.

There is no limitation to a configuration in which the entire hopper retreat region HA1 used for retreating the hopper to the standby position overlaps on the feed usage region FA1 used in feeding (transport) of the medium in the circumferential direction in the circular arc surface 35*a* of the feed roller 35. A portion of the hopper retreat region HA1 only may overlap on the feed usage region FA1. Even in this configuration, it is possible to appropriately perform the skew removal on the medium by excessive reversal of the feed roller 35 being suppressed while being able to reduce the size of the feed roller 35 by an amount corresponding to the portion in the hopper retreat region HA1 that overlaps on the feed usage region FA1. As shown in FIG. 2B, a feed roller 100 may be used in which the feed usage region FA2 and the hopper retreat region HA2 do not overlap at all. Even in this case, in a case in which the rotation shaft receives a force in the reverse direction due to another cause other than the hopper 32 in the discharge operation period, because the medium slips in the feeding process or variations arise the feed start timing of the medium, even in cases where the discharge operation period enters the hopper retreat region HA2, it is possible to appropriately perform the skew removal.

The one-way clutch may not be provided.

The elastic member that biases the hopper is not limited to a coil spring. Other types of spring, such as a torsion coil spring, a plate spring and a wire spring may be used. The elastic member may be rubber.

In the embodiment, in at least a portion (reverse step control execution period) of the skew removal operation period (discharging operation period), although the operation in which the second roller reverses the medium and the operation in which the first motor is driven in a direction in which the medium is reverse transported are alternately performed, the current may continuously flow to the first motor 40, thereby performing reverse driving.

Before the sheet P is discharge to the upstream side in the transport direction from the transport roller pair 53 (that is, when nipped by the transport roller pair 53), the first motor 40 is stopped without a current flowing to the first motor 40. In the period after the sheet P is discharged to the upstream side in the transport direction from the transport roller pair 53 (that is, period when not nipped by the transport roller pair 53), the hold current Ih may flow to the first motor 40. According to the configuration, if the nipping force of the sheet P by to the transport roller pair 53 is stronger than the biasing force of the compression spring 51, even though a great force is applied to the feed roller 35 in the reverse direction due to the biasing force of the compression spring 51, the feed roller 35 is not excessively reversed. In the period in which the nipping by the transport roller pair 53 is released, since the hold current Ih flows to the first motor 40, it is possible to suppress excessive rotation of the feed roller 35.

The skew removal method may be changed between a battery mode in which the battery is the power source and an AC power source mode. The biting and discharging method may be used during the battery mode, and a reverse butting method may be used during AC power source mode. This may be reversed.

The controller that performs the biting and discharging method of skew removal may be realized by software using a CPU that executes a program, may be realized by hardware using an electronic circuit such as an ASIC, or may be realized by cooperation between software and hardware.

As long as the recording apparatus is able to print on a printing medium such as a sheet P, the printing device may be an ink jet printer, a dot impact printer, or a laser printer. The printing device is not limited to a printer provided with only a printing function, and may be a composite device. The printing device is not limited to a serial printer, and may be a line printer or a page printer.

The invention may be applied to a feed device provided in an electronic apparatus other than a recording apparatus such as a printer. For example, the feeding device may feed a medium to be subjected to a work other than recording. Such work may be cutting of a sheet, a work of perforating a sheet, a work folding a sheet, adhering a sheet, or a curing process through ultraviolet irradiation of an ultraviolet curable resin layer on a sheet. A feed device may be used that feeds the medium with the purpose of drying or feeds the medium with the purpose of simply removing skew without performing the work.

The medium is not limited to a sheet, and may be a film made from a resin, a metal foil, a metal film, a composite film (laminate film) of a resin and a metal, a fabric, a non-woven fabric, a ceramic sheet or the like.

The entire discovery of Japanese Patent Application No. 2014-130779, filed Jun. 25, 2014 is expressly incorporated by reference herein.

What is claimed is:

1. A feed device comprising:

a first roller:

a second roller provided further to the downstream side in a transport direction of a medium than the first roller;

a first motor by which the first roller is driven;

a second motor by which the second roller is driven; and a controller that controls the second motor and performs a skew removal operation accompanying reverse transport of the medium by the second roller, wherein the controller causes a suppression current that suppresses the reverse transport speed of the first roller to the reverse transport speed of the second roller or less to flow to the first motor in at least a part of the skew removal operation period in which the skew removal operation is performed by the second roller reverse transporting the medium, the first roller is reversely rotated using a recovery force of the medium that tends to resolve bending formed with the first roller by the second roller reversely transporting the medium in at least a part of the skew removal period in which the skew removal operation is performed by the second roller reversely transporting the medium, and the controller causes a reverse current to flow to the first motor and assists the reversal of the first roller with the recovery force of the medium.

2. The feed device according to claim 1, wherein the suppression current is a hold current that holds the first motor in a stop state.

3. A recording apparatus comprising:

the feed device according to claim 2; and a recording head that performs recording on a medium fed by the feed device.

4. The feed device according to claim 1, wherein the suppression current is the reverse current with a value able to cause the first roller to perform reverse transport at a reverse transport amount of the reverse transport amount of the second roller or less, and the controller drives the first motor to reverse by causing the reverse current to flow to the first motor in the process of the skew removal.

5. A recording apparatus comprising:

the feed device according to claim 3; and a recording head that performs recording on a medium fed by the feed device.

6. The feed device according to claim 1, further comprising:

a hopper on which a medium before feeding is mounted, and that is provided to be displaceable in a state of being biased by an elastic member in a direction approaching the first roller, wherein a rotation shaft of the first roller is interlinked to operate with the hopper via a cam mechanism, and the hopper is operated by resisting the biasing force of the elastic member via the cam mechanism in the rotation region of the first roller in which the skew removal operation is performed.

7. A recording apparatus comprising:

the feed device according to claim 5; and a recording head that performs recording on a medium fed by the feed device.

8. The feed device according to claim 1, wherein the first roller is linked to the first motor to be able to transmit force via a one-way clutch, and the controller drives the first motor to reverse by causing the reverse current as the suppression current to flow to the first motor matching the reversal driving of the second motor in at least a part of the skew removal operation period.

9. A recording apparatus comprising:

the feed device according to claim 8; and a recording head that performs recording on a medium fed by the feed device.

10. A recording apparatus comprising:

the feed device according to claim 1; and a recording head that performs recording on a medium fed by the feed device.

11. A recording apparatus comprising:

the feed device according to claim 1; and a recording head that performs recording on a medium fed by the feed device.

12. A feed device comprising:

a first roller;

a second roller provided further to the downstream side in a transport direction of a medium than the first roller;

a first motor by which the first roller is driven;

a second motor by which the second roller is driven; and a controller that controls the second motor and performs a skew removal operation accompanying reverse transport of the medium by the second roller, wherein the controller causes a suppression current that suppresses the reverse transport speed of the first roller to the reverse transport speed of the second roller or less to flow to the first motor in at least a part of the skew removal operation period in which the skew removal operation is performed by the second roller reverse transporting the medium, and the controller drives the first motor to reverse by causing a reverse current as the suppression current to flow to the first motor in at least a part of the period in which the medium is nipped in the second roller from the skew removal operation period, and thereafter, at least in a period in which the medium is not nipped by the second roller, and a hold current as the suppression current flows to the first motor.

13. A recording apparatus comprising:

the feed device according to claim 12; and a recording head that performs recording on a medium fed by the feed device.

14. A feed device comprising:

a first roller;

a second roller provided further to the downstream side in a transport direction of a medium than the first roller;

a first motor by which the first roller is driven;

a second motor by which the second roller is driven; and a controller that controls the second motor and performs a skew removal operation accompanying reverse transport of the medium by the second roller, wherein the controller causes a suppression current that suppresses the reverse transport speed of the first roller to the reverse transport speed of the second roller or less to flow to the first motor in at least a part of the skew removal operation period in which the skew removal operation is performed by the second roller reverse transporting the medium, and the controller varies the current value to increase and decrease the current by which the first motor is reversed, a plurality of times, in at least a part of the skew removal operation period.

15. A recording apparatus comprising:

the feed device according to claim 14; and a recording head that performs recording on a medium fed by the feed device.

* * * * *